US010883208B2

(12) United States Patent
Novak et al.

(10) Patent No.: US 10,883,208 B2
(45) Date of Patent: Jan. 5, 2021

(54) ROTATING LOOM AND LOOM HOLDER FOR KNITTING

(71) Applicant: Authentic Knitting Board LLC, Fork Union, VA (US)

(72) Inventors: Kim Novak, Salem, MA (US); William Ziegler, Reading, MA (US); Samuel Phelps, Logan, UT (US)

(73) Assignee: Authentic Knitting Board L.L.C., Fork Union, VA (US)

( * ) Notice: Subject to any disclaimer, the term of this patent is extended or adjusted under 35 U.S.C. 154(b) by 302 days.

(21) Appl. No.: 15/873,728

(22) Filed: Jan. 17, 2018

(65) Prior Publication Data

US 2018/0209078 A1 Jul. 26, 2018

Related U.S. Application Data

(60) Provisional application No. 62/448,734, filed on Jan. 20, 2017, provisional application No. 62/550,330, filed on Aug. 25, 2017.

(51) Int. Cl.
*D04B 5/00* (2006.01)
*D03D 29/00* (2006.01)

(52) U.S. Cl.
CPC ..... *D04B 5/00* (2013.01); *D03D 29/00* (2013.01)

(58) Field of Classification Search
CPC ..... D04B 5/00; D03D 29/00
See application file for complete search history.

(56) References Cited

U.S. PATENT DOCUMENTS 769,492 A * 9/1904 Sander ..... D04D 11/00 28/150
769,596 A * 9/1904 Earl ..... D04D 11/00 28/150
2,600,922 A * 6/1952 Rodolfa ..... F16C 33/425 384/614
2,658,364 A * 11/1953 Carlson ..... D04B 9/44 66/4
2,756,780 A * 7/1956 Epstein ..... D03D 29/00 139/30
3,448,701 A * 6/1969 Cordova ..... A47B 11/00 108/20
3,464,648 A * 9/1969 Fuhriman ..... D05B 91/14 242/139

(Continued)

FOREIGN PATENT DOCUMENTS

GB 1915507 6/1911
JP 2003-171854 6/2003

OTHER PUBLICATIONS https://www.goodknitkisses.com/double-knitting-afghan-s-loom/ (Year: 2014).*

(Continued)

*Primary Examiner* — Megan E Lynch
(74) *Attorney, Agent, or Firm* — Nixon & Vanderhye P.C.

(57) ABSTRACT

A swiveling hand loom includes a support base, a plurality of supports connected to the base and extending vertically to support a loom having a plurality of pegs thereon in elevated fashion. The base includes a swiveling mechanism permitting the loom to swivel relative to the support base which allows the knitter to work on his or her lap and not have to move the loom position.

12 Claims, 22 Drawing Sheets

(56) References Cited

U.S. PATENT DOCUMENTS

| | | | | | |
|---|---|---|---|---|---|
| 3,717,012 | A * | 2/1973 | Misner | D04C 3/00 | 66/1 A |
| 3,757,395 | A * | 9/1973 | Nepon | D03D 29/00 | 28/152 |
| 3,858,529 | A * | 1/1975 | Salladay | A47B 31/00 | 108/103 |
| 3,971,109 | A * | 7/1976 | Garza | D03D 29/00 | 28/151 |
| 4,131,138 | A * | 12/1978 | Boisvert | D03D 29/00 | 139/29 |
| 4,195,670 | A * | 4/1980 | Orr | D03D 29/00 | 139/192 |
| 5,005,273 | A * | 4/1991 | Packham | D03D 29/00 | 139/34 |
| 5,231,742 | A * | 8/1993 | Macbain | D03D 29/00 | 139/34 |
| 8,596,096 | B1 * | 12/2013 | Russell | D04B 3/00 | 66/4 |
| 9,234,306 | B1 * | 1/2016 | Chang | D04B 3/00 | |
| 2008/0156043 | A1 * | 7/2008 | Gustin | D04B 3/00 | 66/4 |
| 2011/0259465 | A1 * | 10/2011 | Schaub | D03D 29/00 | 139/29 |
| 2012/0047960 | A1 * | 3/2012 | Sasur | D04B 3/00 | 66/1 A |
| 2015/0337468 | A1 * | 11/2015 | Le Costaouec | D04H 1/4242 | 28/108 |
| 2016/0032500 | A1 * | 2/2016 | Novak | D03D 29/00 | 28/152 |
| 2017/0130375 | A1 * | 5/2017 | Todokoro | D04B 3/00 | |
| 2017/0152614 | A1 * | 6/2017 | Hamer | D04B 3/00 | |
| 2017/0175311 | A1 * | 6/2017 | Devagnanam | D04B 5/00 | |

OTHER PUBLICATIONS

EP Communication issued in corresponding EP Application No. 18 152 374.4 dated Feb. 22, 2019 (5 pages).

Extended European Search Report dated Mar. 6, 2018, in a corresponding European Patent Application No. 18152375.4 (13 pages).

Good Knit Kisses: "Loom Holders by Loom Knitting Gadgets (Discontinued item)", Dec. 5, 2014, SP054978147, retrieved from the Internet: URL:https://www.youtube.com/watch?v=NBMWSdV6_Es [retrieved on Feb. 23, 2018) (2 pages).

* cited by examiner

ROTATING LOOM AND LOOM HOLDER FOR KNITTING

CROSS REFERENCE TO RELATED APPLICATIONS

This application claims the benefit of U.S. Provisional Application Ser. No. 62/448,734, filed Jan. 20, 2017 and 62/550,330, filed Aug. 25, 2017, each of which is hereby incorporated herein by reference in its entirety.

TECHNICAL FIELD

The present technology relates generally to looms for knitting and weaving, and more particularly to rotating looms and loom holders.

BACKGROUND

Knitting and weaving have long been popular hobbies and a large variety of items can be made on a loom. A typical loom includes pegs that project from the frame around which the yarn is looped in various ways, such as running back and forth between opposite sides of the frame or from peg to peg around a perimeter of the loom. However, there are limitations associated with ease of use of the loom characterized by the prior art.

SUMMARY

One aspect of the disclosed technology relates to a hand loom that creates double knit in a tubular shape.

Another aspect of the disclosed technology relates to a swiveling or rotating hand loom.

Another aspect of the disclosed technology relates to a swiveling or rotating base that interchangeably hold a plurality of different sized and/or shaped looms.

Another aspect of the disclosed technology relates a swiveling hand loom, comprising: a support base; a plurality of supports extending vertically in a direction away from the support base; at least one loom connected to upper portions of the plurality of supports, the at least one loom having a plurality of pegs thereon; and a swiveling mechanism permitting the at least one loom to swivel relative to the support base.

Another aspect of the disclosed technology relates to a swiveling loom holder for interchangeably holding plural looms, comprising: a base; a plurality of support structures extending vertically in a direction away from the base; an adjustable loom support respectively connected to each support structure, the adjustable loom supports configured to collectively and removably support plural looms interchangeably thereon; and a swiveling mechanism permitting the adjustable loom supports to swivel collectively relative to the support base.

Another aspect of the disclosed technology relates to a hook for knitting, comprising: a handle; two shanks extending from the handle in parallel with one another; and two hooks extending, respectively, from the shanks in parallel with one another.

Another aspect of the disclosed technology relates to a double-knit loom, comprising: a round inner loom having a plurality of pegs thereon; and a round outer loom having a plurality of pegs thereon, wherein the outer loom is concentrically disposed relative to the inner loom for double-knitting.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various embodiments of this technology. In such drawings.

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

Figure 1:
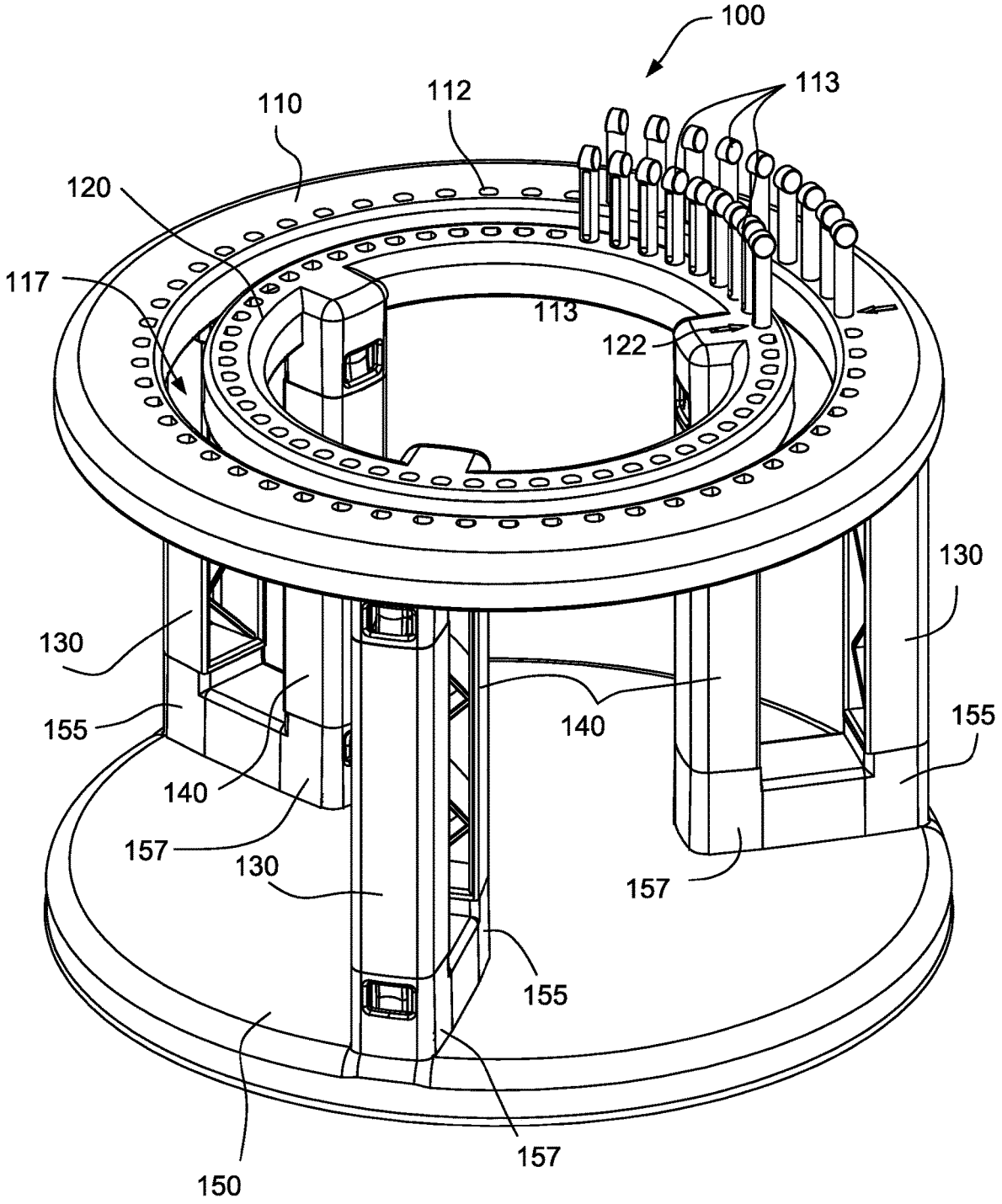
FIG. 1 is a perspective view of a rotating double-knit loom according to an example of the disclosed technology.
Figure 2:
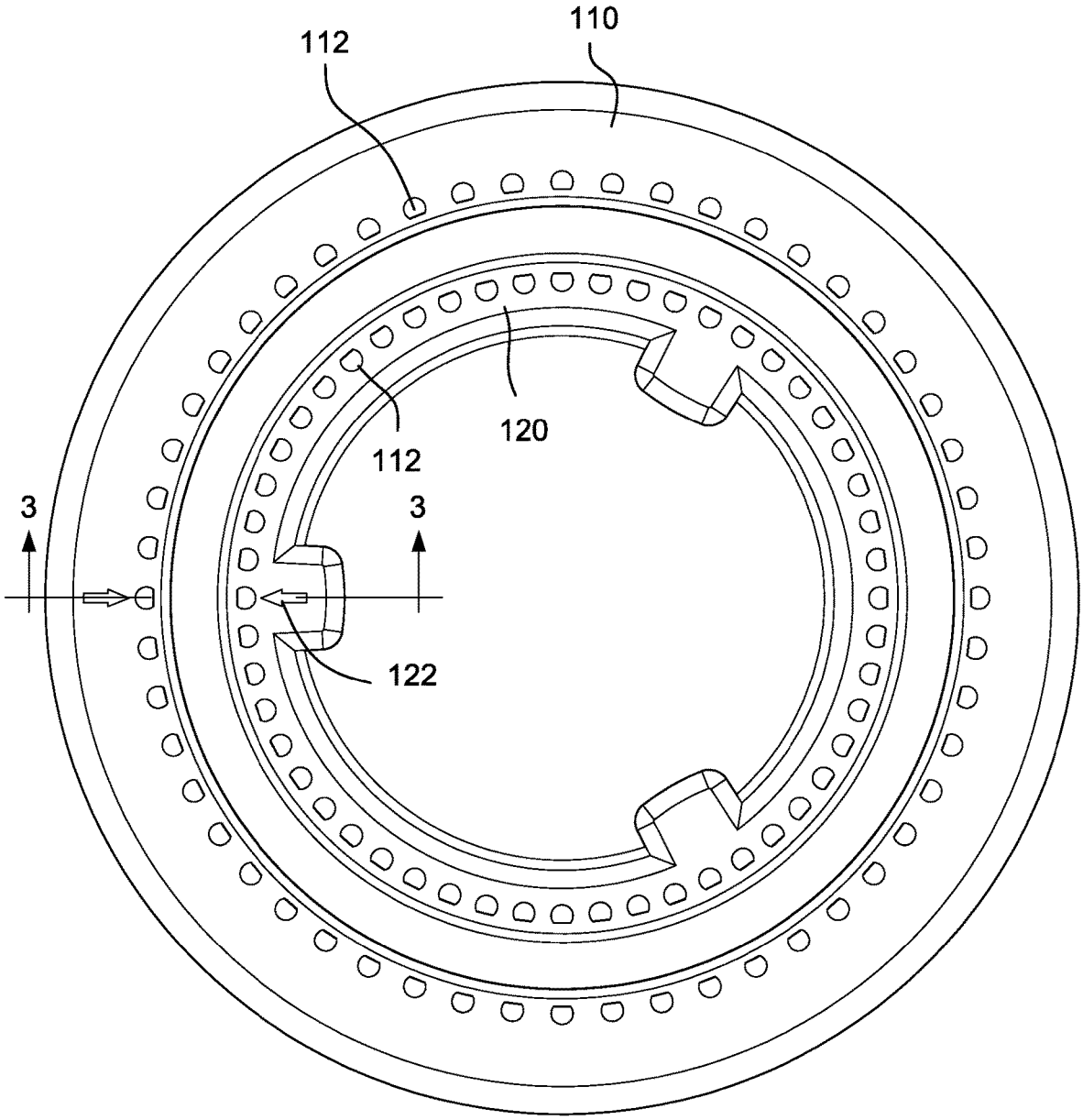
FIG. 2 is a top view of the rotating double-knit loom of FIG. 1.

Referring to FIGS. 1 and 2, a rotating double-knit loom 100 is shown. The double-knit loom comprises base 150, a plurality of supports (e.g., support legs 130, 140), outer loom 110, and inner loom 120. The support legs 130, 140 are connected to and extend vertically from base 150 to support outer loom 110 and inner loom 120 in an elevated manner.

Figure 4:
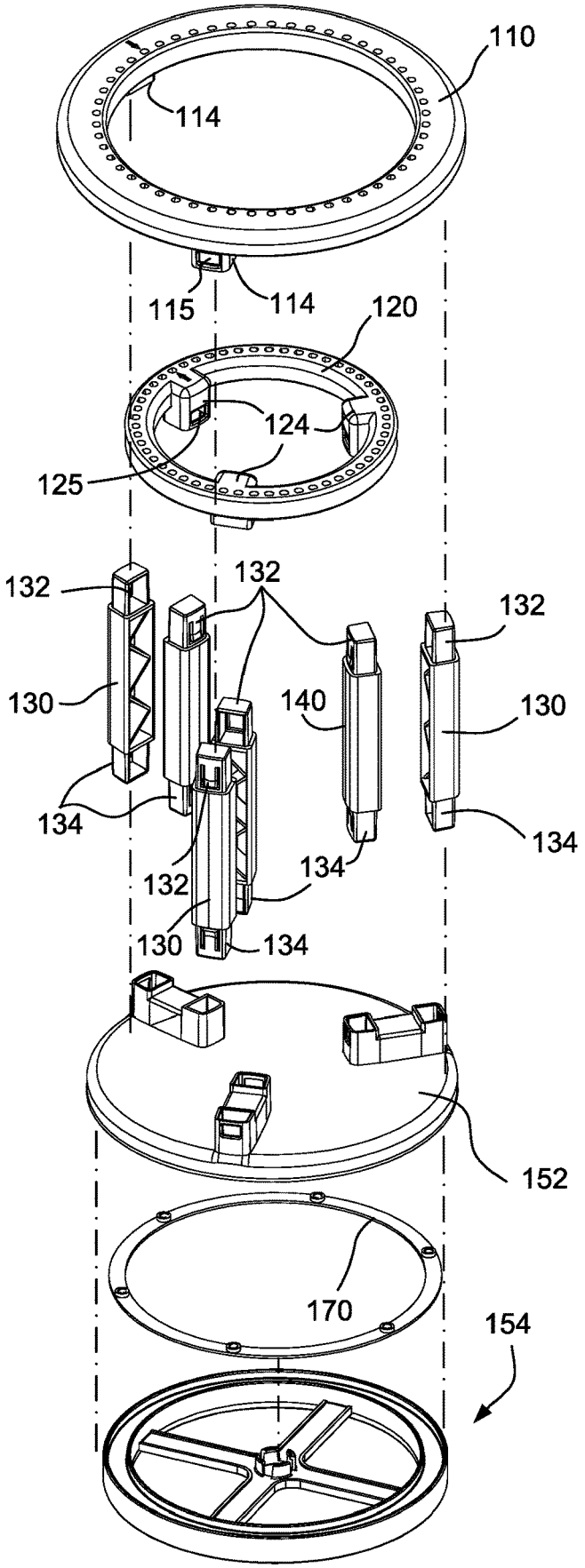
FIG. 4 is an exploded perspective view of the rotating double-knit loom of FIG. 1.
Figure 5:
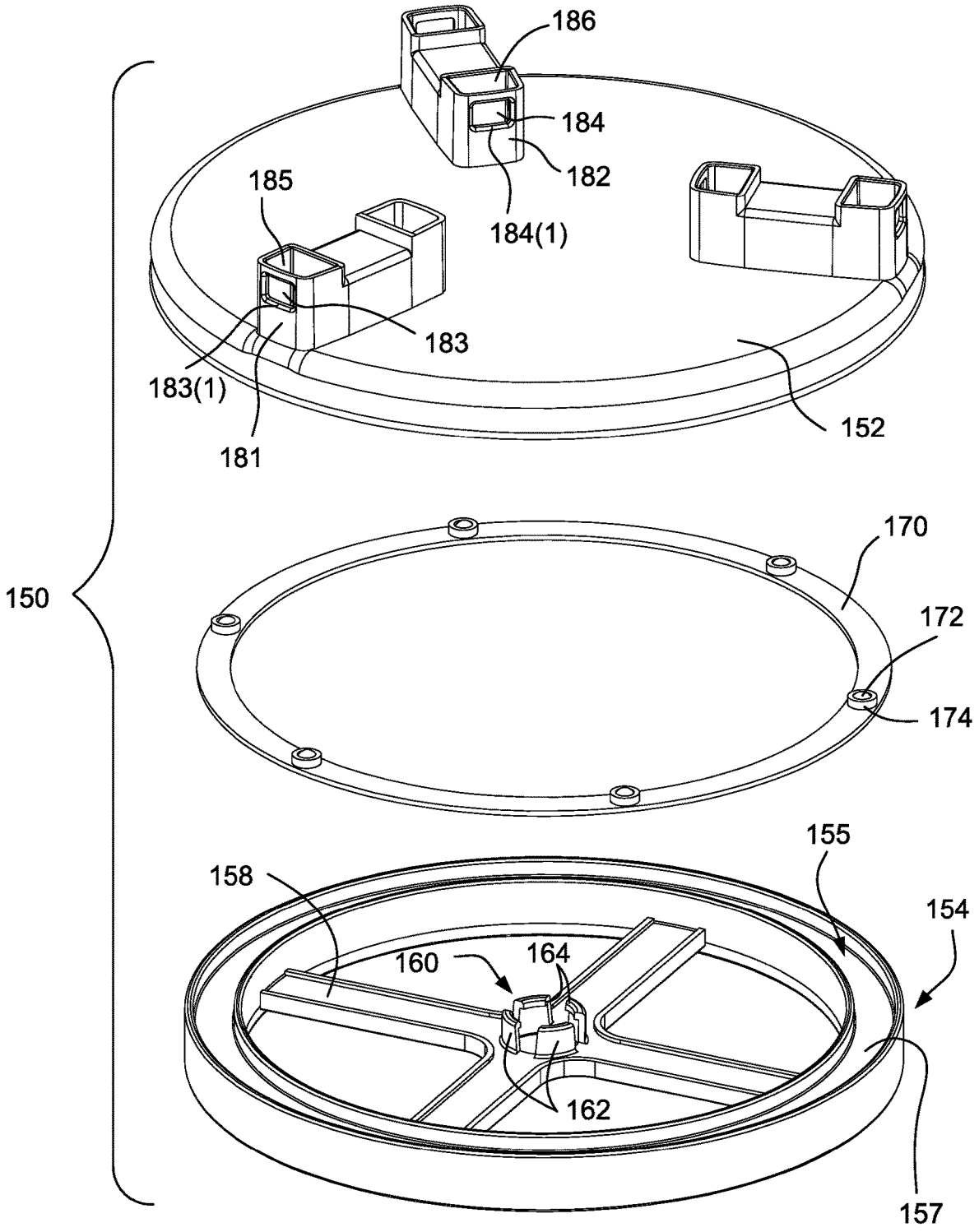
FIG. 5 is a top exploded perspective view of the base of the rotating double-knit loom of FIG. 1.
Figure 6:
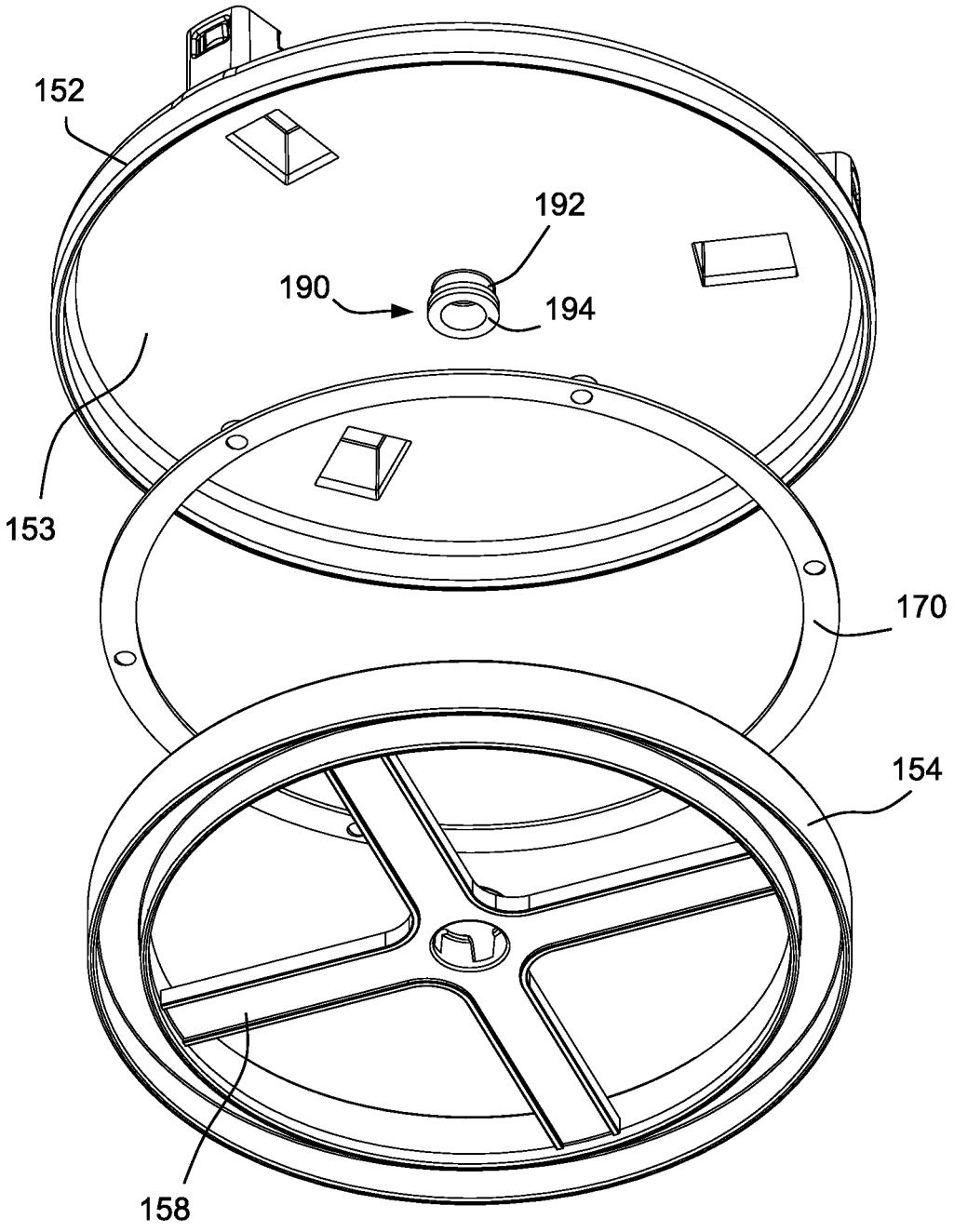
FIG. 6 is a bottom exploded perspective view of the base of FIG. 5.

As shown in FIGS. 4-6, base 150 comprises upper portion 152, lower portion 154, and bearing plate 170. The lower portion 154 may have an annular or ring shape with a plurality of supports extending across the inner diameter of the lower portion, as shown in FIG. 5. The lower portion 154 comprises a connector (e.g., female connector 160 or knob-receiving connector) including a plurality of tabs 162. The tabs 162 are spaced apart and connected at their lower ends to lower portion 154 of the base.

In this manner, tabs 162 are resiliently disposed so as to flex to receive a connector (e.g., male connector 190 or protruding connector) provided on the bottom of the upper portion 152 of the base. The male connector 190 includes neck 192 which extends from the bottom of the upper portion and knob 194 provided on the neck, as shown in FIG. 6. The knob 194 has a width or diameter that is larger than a width or diameter of the neck such that tabs 162 can resiliently flex to receive the knob 194 and then move back towards their original positions to prevent the knob from being removed from the tabs. The top portion of each tab 162 may be provided with an inclined surface to facilitate receipt of the knob 194, as those skilled in the art will understand. Additionally, the top portion of each tab 162 may include rib 164 protruding radially inwardly and configured to be positioned in the area around neck 192 of male connector 190 thereby blocking knob 194 from being removed from the tabs.

This arrangement permits the tabs to rotate relative to the male connector. By this arrangement, upper portion 152 of the base may swivel relative to the lower portion 154, thereby forming a swiveling mechanism. This allows the knitter to work on his or her lap and not have to move the loom position. Instead, the knitter can simply spin the loom to the correct position. This allows the work to be performed at one location.

Those skilled in the art will recognize that male 190 and female 160 connectors may be reversed and that other suitable arrangements which permit the base to swivel may be used.

To facilitate the swiveling action of the base, bearings may be used. For example, bearing plate 170 may be disposed in groove 155 in lower portion 154 of the base, as shown in FIGS. 5 and 6. The bearing plate 170 may be a thin plate, e.g., disk shaped with a hole in the middle, having a plurality of spaced bearings 172 embedded in the plate in bearing holders 174. The upper portion 152, lower portion 154, and bearing plate 170 are arranged such that the bearings 172 engage a bottom surface of the upper portion 152 and a bearing engagement surface 157 in lower portion 154.

It is noted that the bearing plate may also be a plate of any desired shape or thickness and may have a plurality of ball bearings captured within and freely running in a circular track. In some applications, the bearing plate may not have a hole in its middle.

Referring to FIG. 5, base 150 has provided thereon, e.g., on an upper surface of the upper portion 152, a plurality of connectors (e.g., outer connector structures 181 (e.g., receptacles) and inner connector structures 182 (e.g., receptacles).

In the illustrated example, three outer connector structures 181 are shown. The outer connector structures 181 may be equally-spaced along a circumference of the upper portion 152. The outer connector structures 181 are also equally-spaced from a center point of the upper portion 152.

Still referring to FIG. 5, each outer connector structure 181 includes an opening 185 formed at an upper end thereof. A front face of the outer connector structure 181 has an aperture 183 formed therein. An upper edge of aperture 183 forms engaging surface 183(1).

Figure 11:
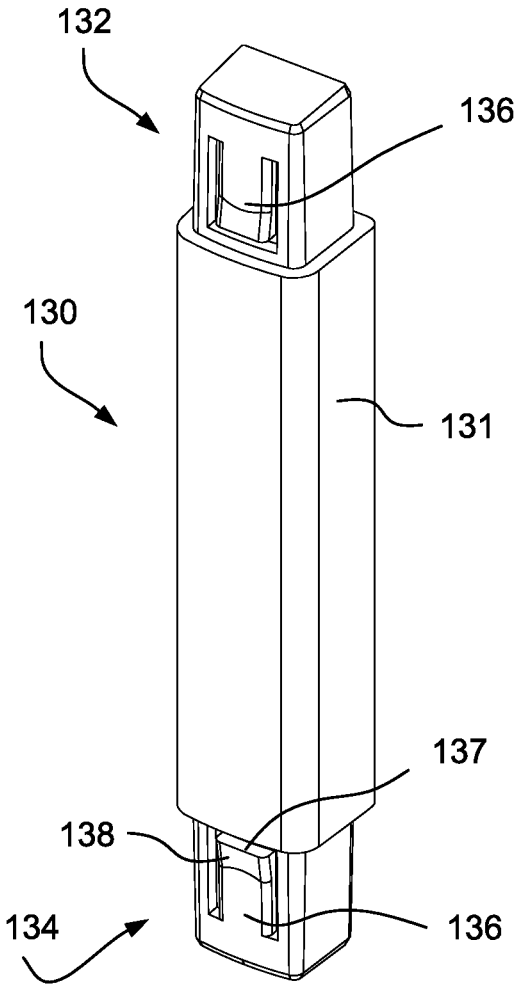
FIG. 11 is a front perspective view of a support leg of the rotating double-knit loom of FIG. 1.
Figure 12:
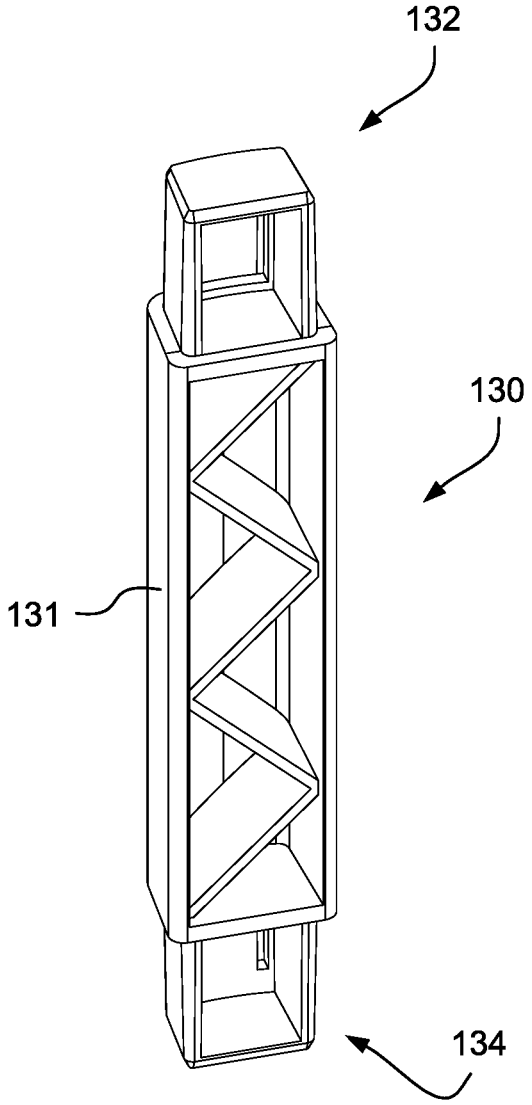
FIG. 12 is a rear perspective view of the support leg of FIG. 11.

Referring to FIGS. 1, 4, 5, 11 and 12, each outer connector structure is configured to detachably connect to lower connector 134 of support leg 130. As shown in FIGS. 11 and 12, each support leg includes body portion 131, upper connector 132 and lower connector 134. Each of upper connector 132 and lower connector 134 includes a tab 136 having an inclined surface 138 and a stop 137 provided at an end of the inclined surface.

The lower connector 134 is configured to be inserted into opening 185 of a respective outer connector structure 181 to form a snap-fit connection therewith. As lower connector 134 is inserted into opening 185, inclined surface 138 engages a wall of outer connector structure 181 surrounding opening 185 so as to cause tab 136 to resiliently flex inwardly until stop 137 reaches aperture 183. The tab 136 then moves towards its original position and stop 137 is positioned against the engaging surface 183(1) of outer connector structure 181 to secure support leg 130 to base 150.

Referring to FIG. 5, in the illustrated example, three inner connector structures 182 are also shown. Inner connector structures 182 may be equally-spaced along a circumference of upper portion 152, concentrically and radially inwardly of outer connector structures 181.

The inner connector structures 182 are similar to outer connector structures 181 described above. Respective inner and outer connector structures may be joined together as shown in FIG. 5 or may extend from base 150 separately. Each inner connector structure 181 includes an opening 186 formed at an upper end thereof, as shown in FIG. 5. A front face of the inner connector structure 182 has an aperture 184 formed therein. An upper edge of aperture 184 forms engaging surface 184(1).

Referring to FIGS. 1, 4, 5, 11 and 12, each inner connector structure 182 is configured to detachably connect to lower connector 134 of a respective support leg 140 in the same manner as described above with regard to outer connector structure 181. In the illustrated example, support leg 140 is identical to support leg 130, which is described in detail above. Support legs 130 may be referred to as outer support legs whereas support legs 140 may be referred to as inner support legs.

Outer loom 110 is configured to detachably connect to outer support legs 130, and inner loom 120 is configured to detachably connect to inner support legs 140, as shown in FIGS. 1 and 4.

Figure 7:
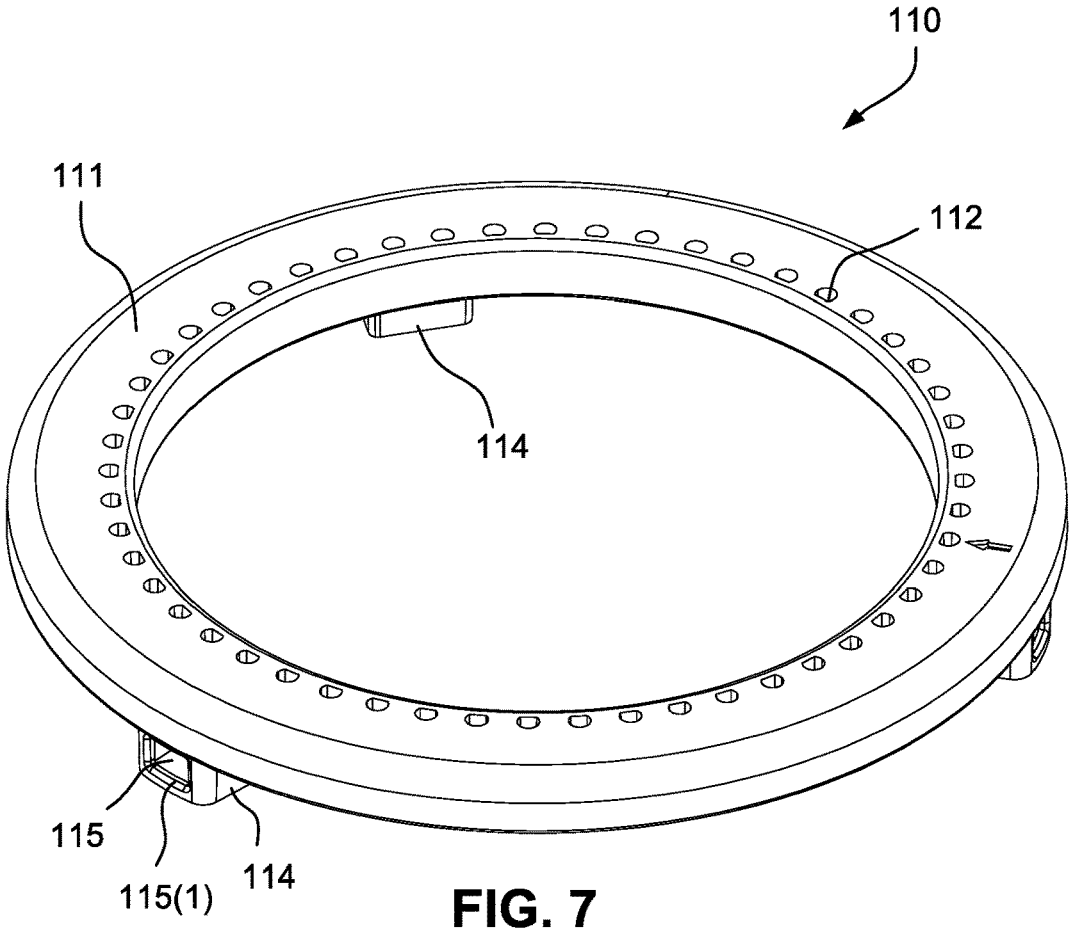
FIG. 7 is a top perspective view of an outer loom of the rotating double-knit loom of FIG. 1.
Figure 8:
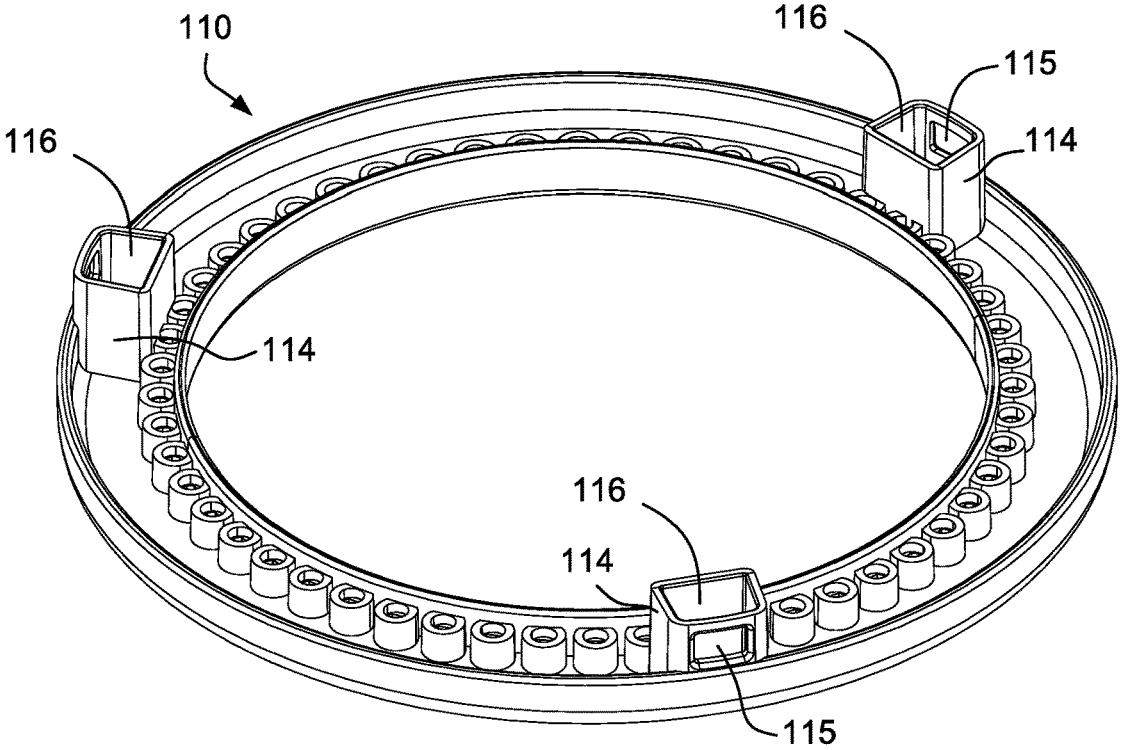
FIG. 8 is a bottom perspective view of the outer loom of FIG. 7.

Turning to FIGS. 1, 7 and 8, outer loom 110 is shown. Outer loom 110 includes base 111 having a plurality of holes 112 formed therein for receiving pegs 113. Only a few pegs are shown in FIG. 1. Those skilled in the art will understand that pegs are installed in all of the holes 112. Pegs 113 are omitted in most of the remaining figures so that details of the drawings can be clearly seen. Pegs 113 may have a groove provided along a middle of the peg to allow a knit hook to be positioned in the groove for picking up the yarn, as those skilled in the art understand. The outer loom has an annular or ring shape and may be referred to as a round loom. A plurality of connector structures 114 (e.g., receptacles) may be equally spaced along a circumference of outer loom 110.

Each connector structure 114 includes an aperture 115, an engaging surface 115(1) and opening 116 and is configured to detachably connect to upper connector 132 of the outer support legs 140. Connector structure 114 connects to support legs 140 in the same manner as the connection between support legs 140 and outer connector structure 181 of base 150, as described above.

Figure 9:
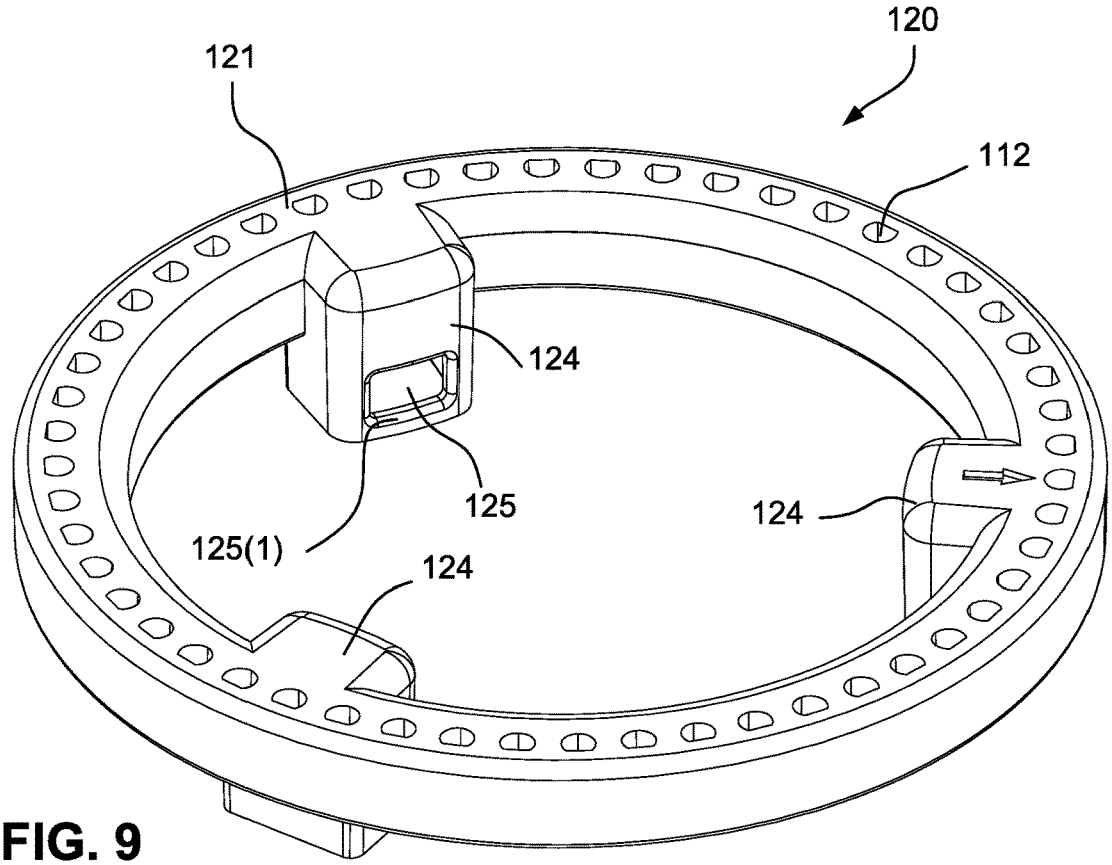
FIG. 9 is a top perspective view of an inner loom of the rotating double-knit loom of FIG. 1.
Figure 10:
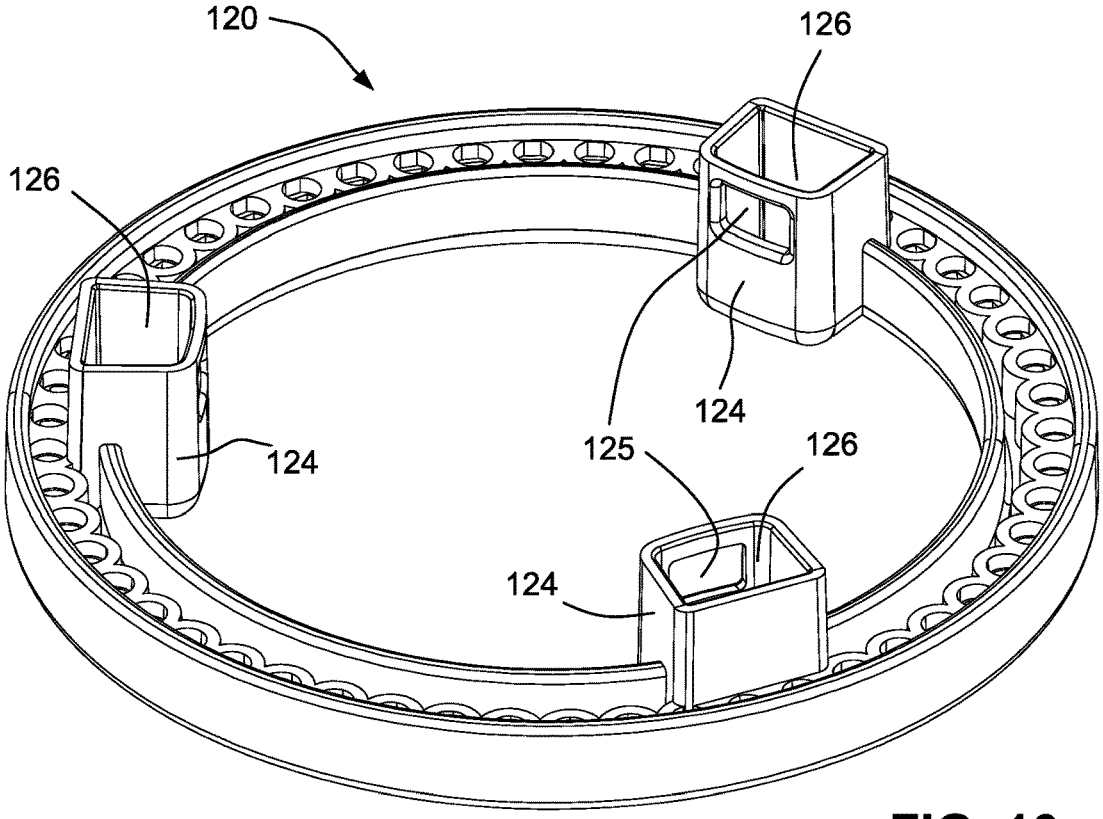
FIG. 10 is a bottom perspective view of the inner loom of FIG. 9.

Referring to FIGS. 1, 9 and 10, inner loom 120 is shown. Inner loom 120 includes base 121 having a plurality of holes 112 formed therein for receiving pegs 113. The inner loom has an annular or ring shape (and may be referred to as a round loom) with a diameter that is smaller than a diameter of the outer loom 110 so that the inner loom and the outer loom can be concentrically arranged, as shown in FIGS. 1 and 2. A plurality of connector structures 124 (e.g., receptacles) may be equally spaced along a circumference of inner loom 120.

Each connector structure 124 includes an aperture 125, an engaging surface 125(1) and opening 126 and is configured to detachably connect to upper connector 132 of the inner support legs 130. Connector structure 124 connects to support legs 130 in the same manner as the connection between support legs 140 and outer connector structure 181 of base 150, as described above.

Support legs 130, 140 are elongate members, therefore outer loom 110 and inner loom 120 are supported in an elevated manner with respect to base 150, as shown in FIG. 1. This allows the knitted material to fall into and be accommodated by the space between base 150 and the inner and outer looms 120, 110. The support legs keep the spacing between the looms open.

The outer loom and the inner loom are positioned vertically level with one another for double-knitting such that the pegs 113 of inner loom 120 are directly opposed to pegs 113 of outer loom 110, as those skilled in the art will understand.

Rotating double-knit loom 100 can be used to create double knit in a tubular shape, double knit flat panel, single knit tubular, and single knit flat panel, for example. Loom 100 can be used with both inner loom 120 and outer loom 110 installed, with the outer loom only (knitting falls to inside of loom), or with the inner loom only (knitting falls to inside or outside of loom depending on which side of the inner loom is used as the front of the loom). For single knitting in the round and flat panel, only the outer loom or only the inner loom is used. For double knitting, both inner and outer looms are used.

Figure 3:
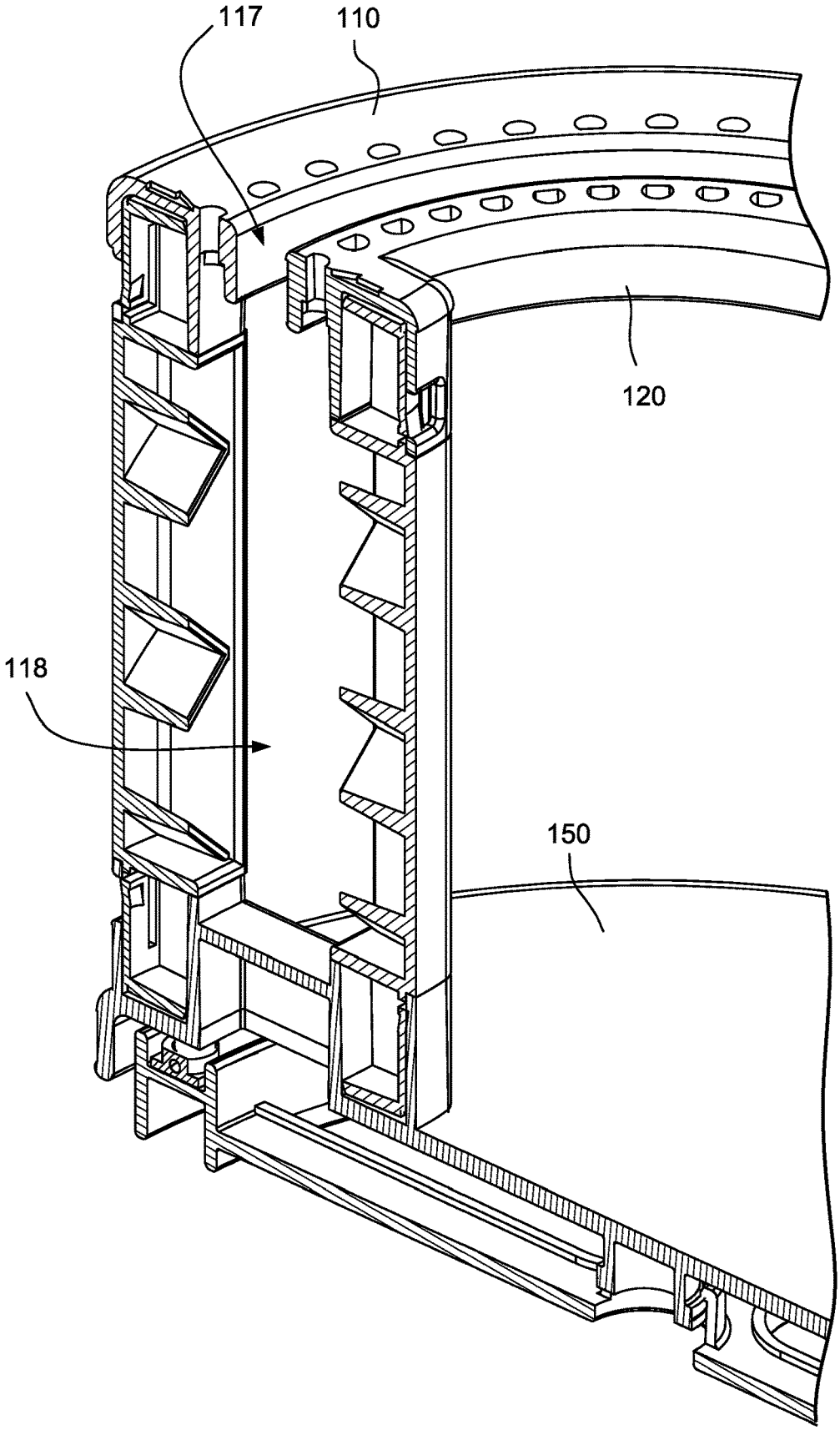
FIG. 3 is a cross-sectional view along the line 3-3 in FIG. 2.

Referring to FIGS. 1-3, when knitting in double knit the finished knit progresses down through gap 117 to a space 118 between inner loom 120 and outer loom 110. Inner loom 120 and outer loom 110 are not directly connected and therefore gap 117 exists. However, by way of legs 130, 140, outer loom 110 and inner loom 120 are both connected to base 150.

Gap 117 is continuous and separates inner loom 120 and outer loom 110 along their entire circumferences. This arrangement of the inner loom and outer loom is especially useful for hats, or other knitwear that is tubular shaped.

The loom parts, for example base 150, support legs 130, 140, outer loom 110 and inner loom 120 may be made of plastic but other suitable materials may be used, such as nylon, aluminum, wood etc.

Figure 13:
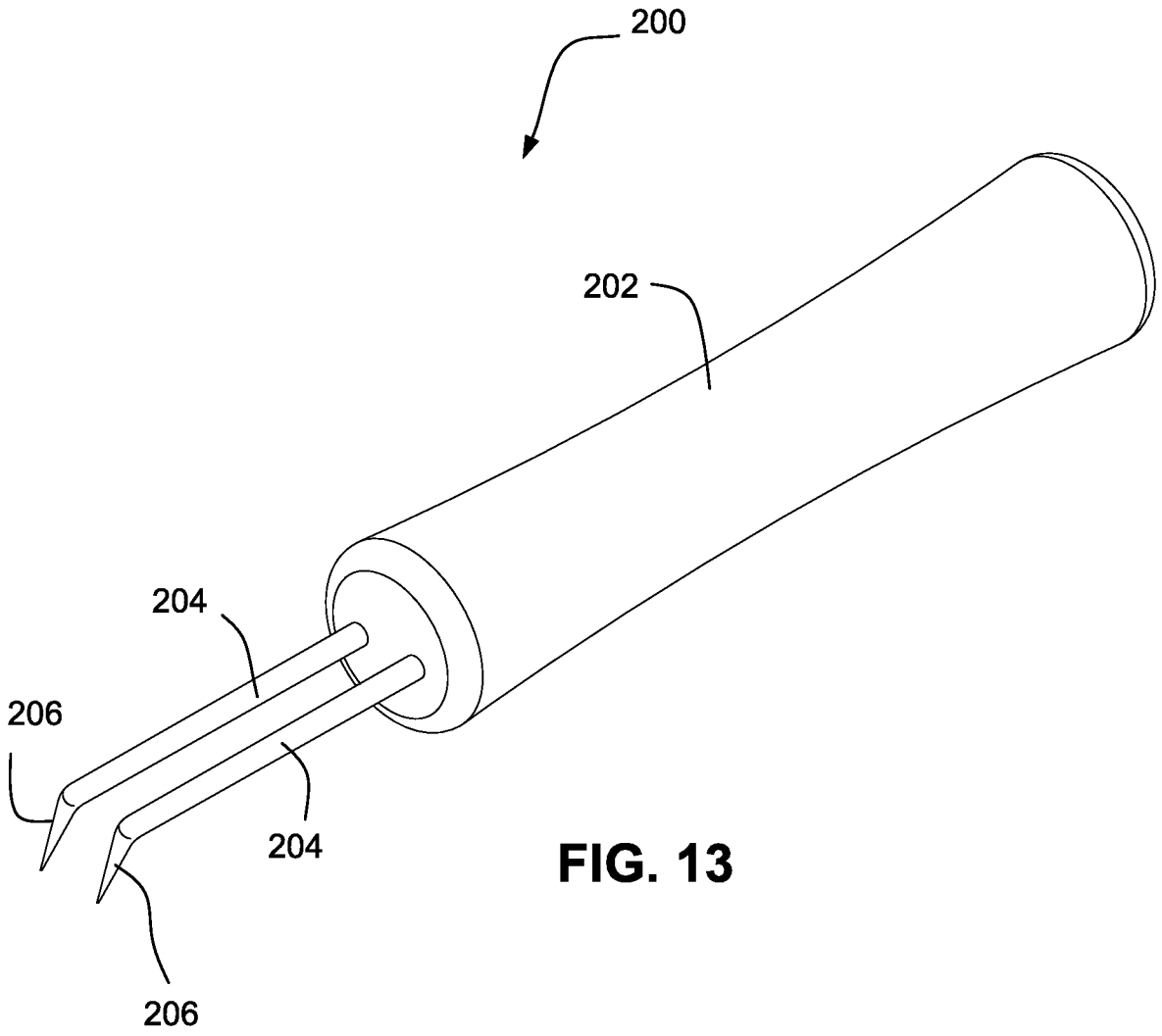
FIG. 13 is a perspective view of a double loom knitting hook according to an example of the disclosed technology.

Turning to FIG. 13, a double loom knitting hook 200 is shown. Double loom knitting hook 200 allows the loom knitter to knit two pegs at a time, speeding up the loom knitting process. In the looming process, loops/stitches are created on the pegs. When each peg has two loops/stitches, the hooking or knitting process begins by taking the bottom loop over the top loop. With the double hook, two pegs can be worked at a time.

The illustrated knitting hook comprises a handle 202, and two hooks 206 at respective ends of two shanks 204. Shanks 204 extend from handle 202. Hooks 206 may be conical portions tapering from a bend at the connection with shank 204 to an end of the hook. The shanks may extend in parallel. The hooks may also be disposed in parallel. In an alternate embodiment, a single shank terminates with two hooks.

Figure 14:
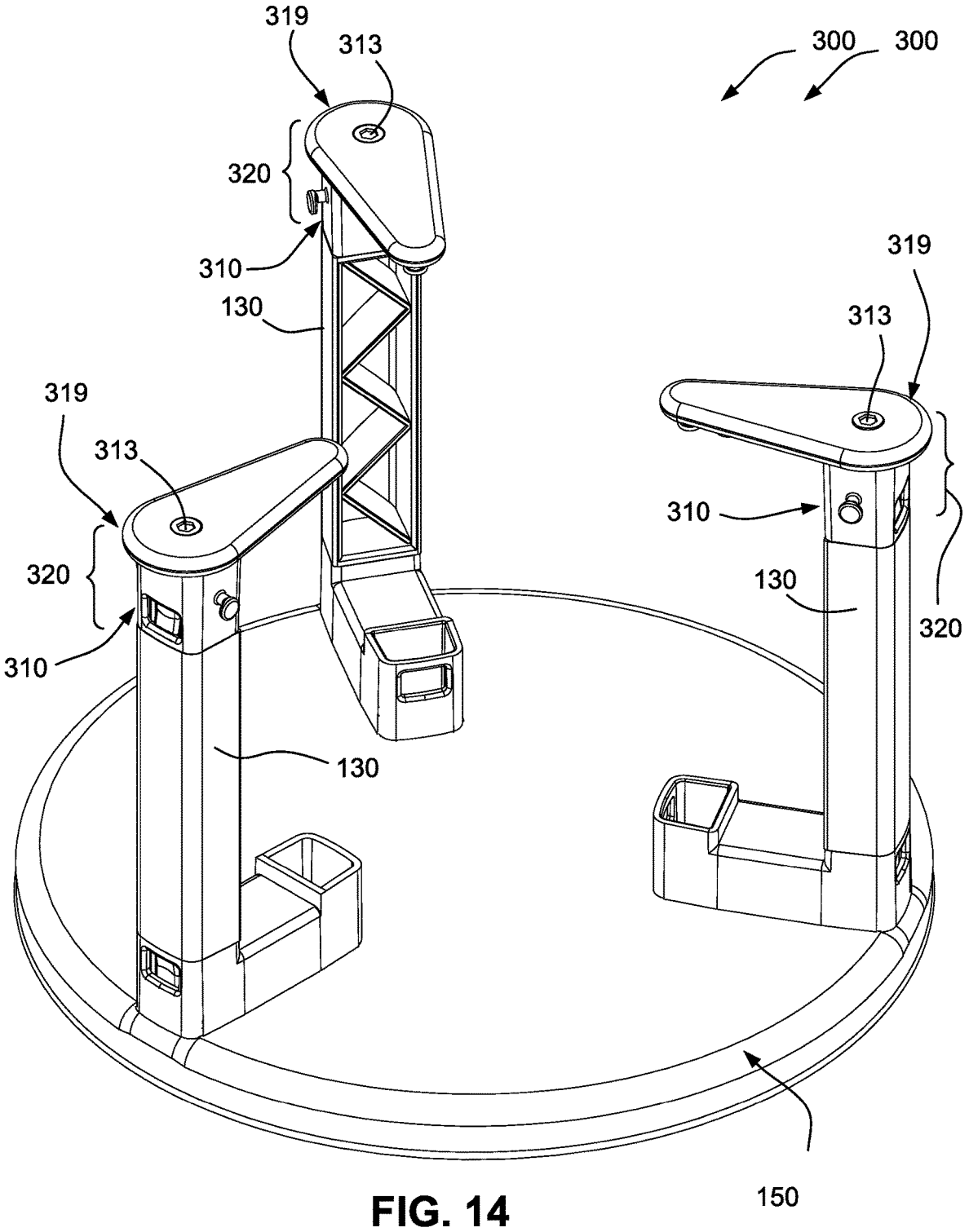
FIG. 14 is a top perspective view of a rotating loom holder according to an example of the disclosed technology.
Figure 15:
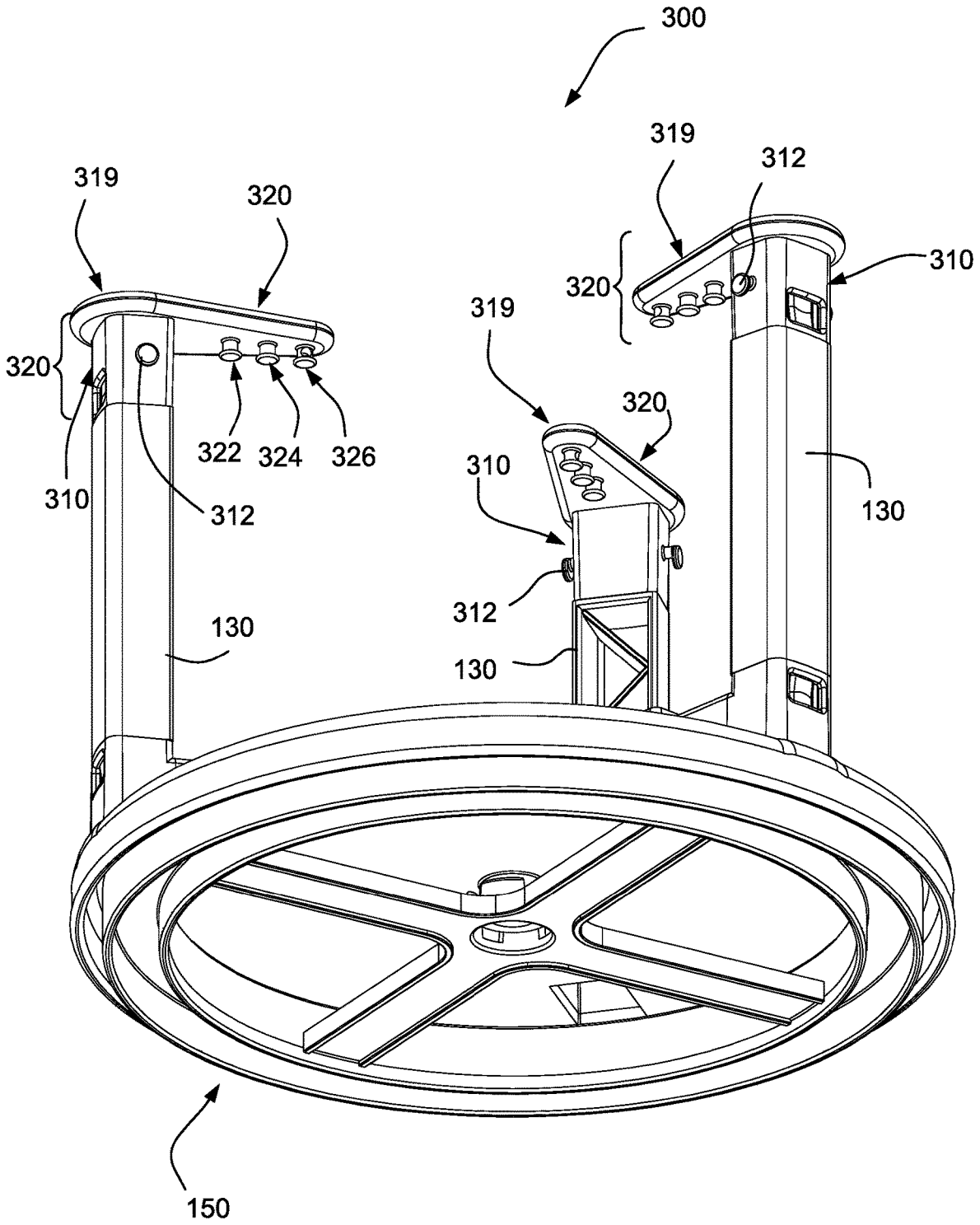
FIG. 15 is a bottom perspective view of the rotating loom holder of FIG. 14.
Figure 16:
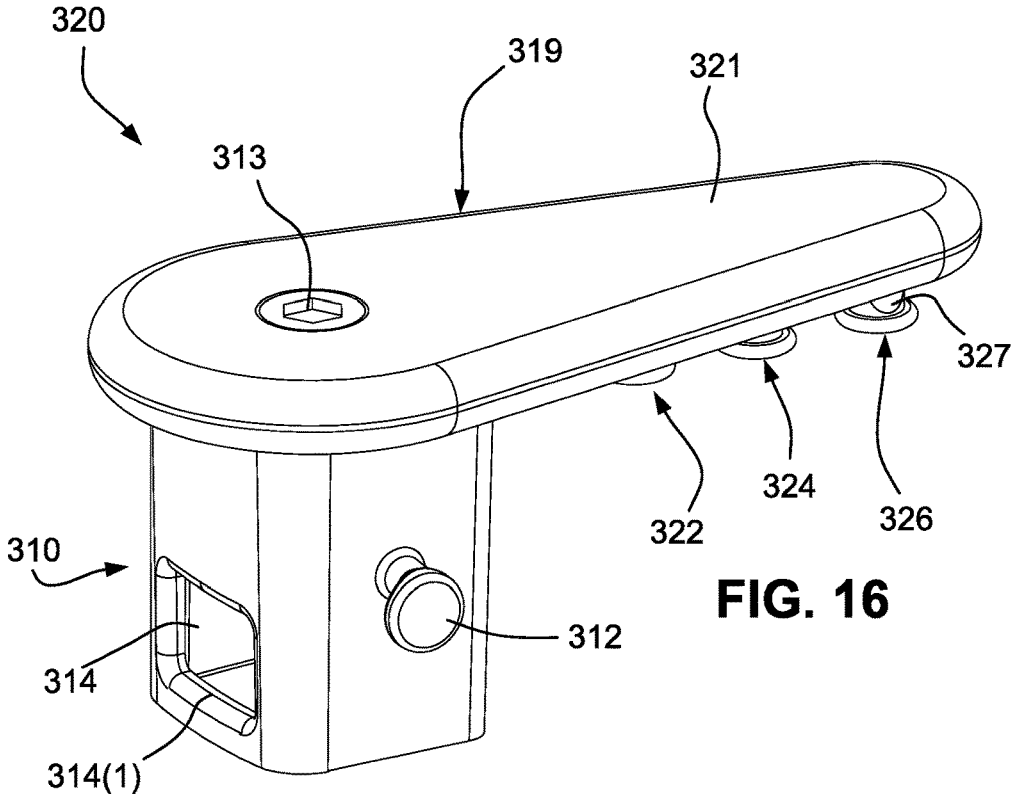
FIG. 16 is a top perspective view of an adjustable loom support of the rotating loom holder of FIG. 14.
Figure 17:
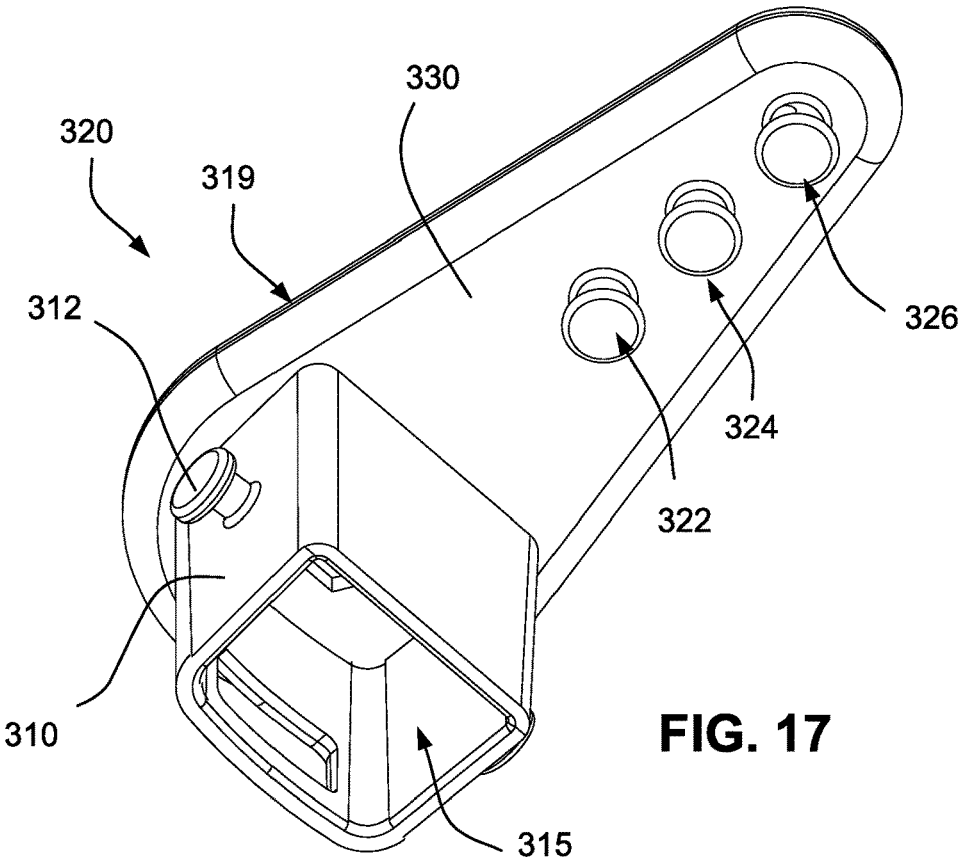
FIG. 17 is a bottom perspective view of the adjustable loom support of FIG. 16.

Referring to FIGS. 14 and 15, a swiveling loom holder 300 is shown. With outer loom 110 and inner loom 120 removed, the rotating double-knit loom described above converts into a device for interchangeably holding a variety of looms by provision of an attachment for the rotating base 150 and support legs 130, 140. Loom holder 300 may be configured to hold any loom (having any shape, e.g., round, square, oval, rectangle, S-shape, etc.) so as to enable the loom to be rotatable (e.g., swivelable, or rotatable relative to the base such that a user can rotate the loom relative to the user when in use).

A plurality of adjustable loom supports 320 (e.g., three loom supports) is configured to be removably attached to the support legs, as shown in FIGS. 14 and 15. Each adjustable loom support 320 includes leg attachment 310 and shelf 319. Turning to FIGS. 16, 17 and 19-21, leg attachment 310 may have connector structure that is the same as connector structure 114 (of outer loom 110) for connecting to upper connector 132 of support leg 130. That is, leg attachment 310 includes an aperture 314, an engaging surface 314(1) and opening 315 and is configured to detachably connect to upper connector 132 of the support legs 130, 140. Leg attachment 310 connects to support legs 130, 140 in the same manner as the connection between support legs 140 and outer connector structure 181 of base 150, as described above.

Figure 18:
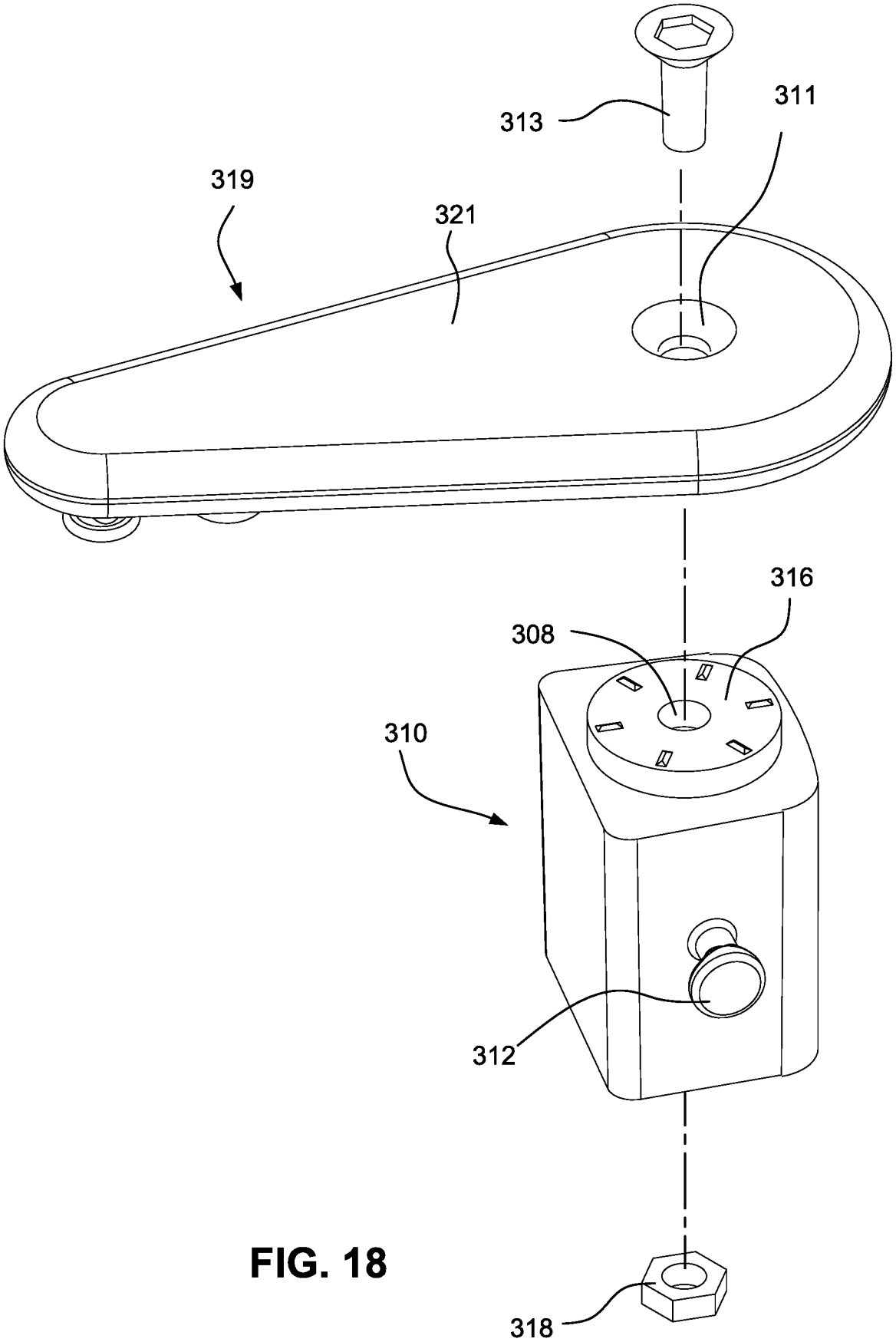
FIG. 18 is an exploded view of the adjustable loom support of FIG. 16.
Figure 19:
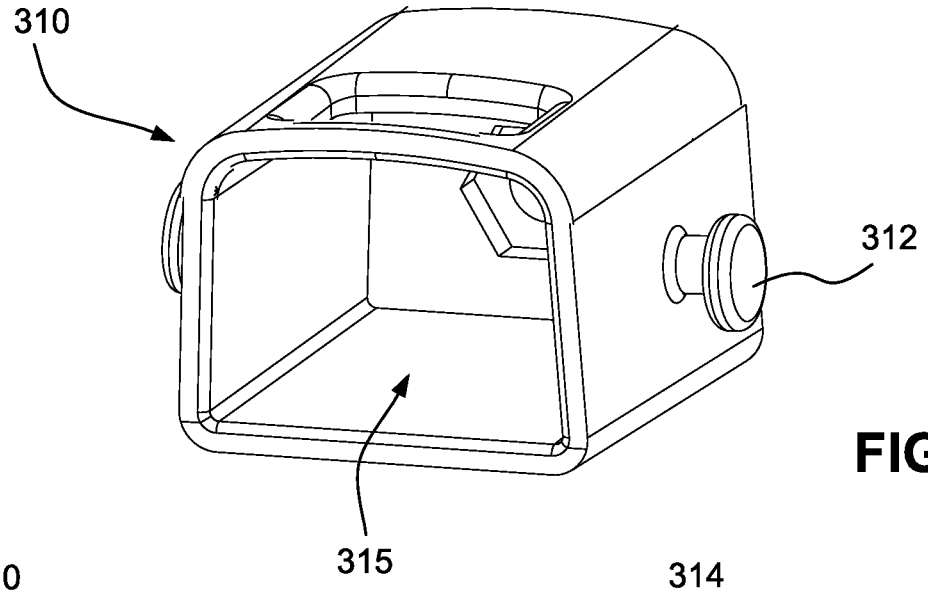
FIG. 19 is a top perspective view of a leg attachment of the adjustable loom support of FIG. 16.

Referring to FIG. 18, an attachment device (e.g., screw 313) and fastener (e.g., nut 318) are provided to secure leg attachment 310 to shelf 319. Screw 313 is provided through hole 311 in shelf 319 and hole 308 in leg attachment to connect the shelf and leg attachment.

Figure 20:
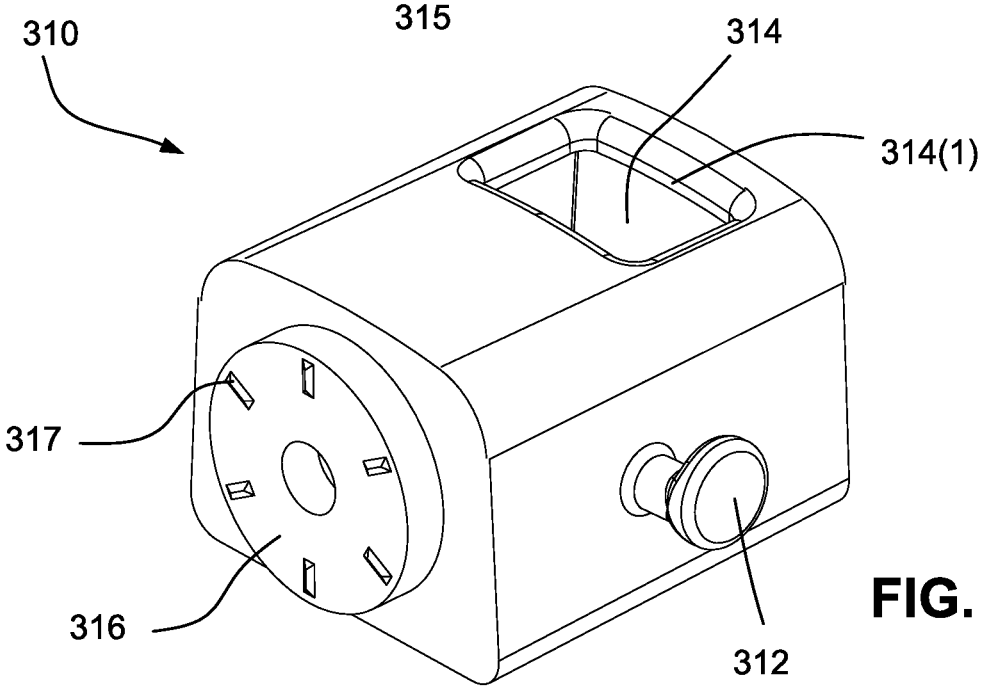
FIG. 20 is a side perspective view of the leg attachment of FIG. 19.
Figure 21:
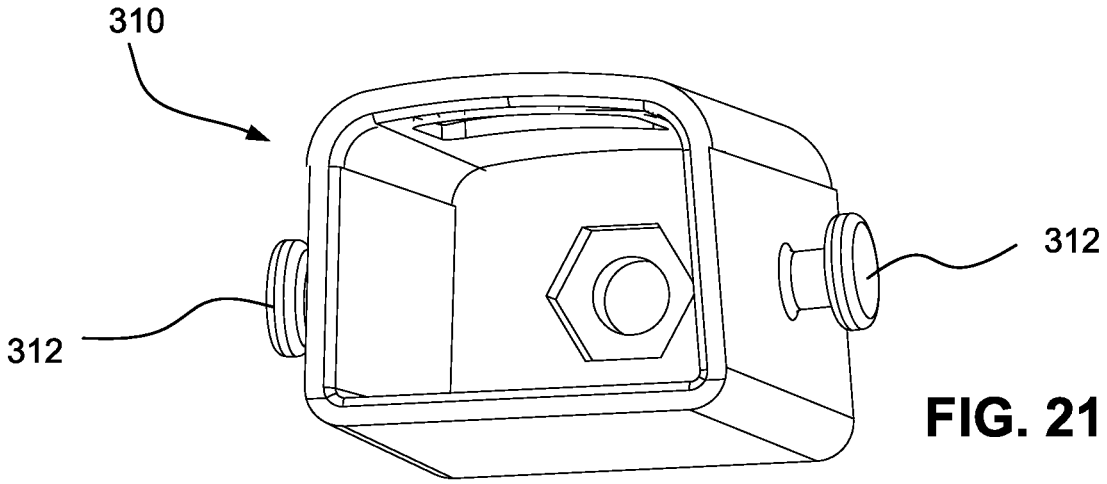
FIG. 21 is a bottom perspective view of the leg attachment of FIG. 19.

Turning to FIG. 20, leg attachment 310 includes an adjustable connector 316 having a plurality of recesses (e.g., wedge-shaped recesses 317). Connector 316 may be configured to be attached to shelf by being inserted (e.g., with an interference fit) in receiving space 328 of shelf 319 (see FIG. 23).

Figure 23:
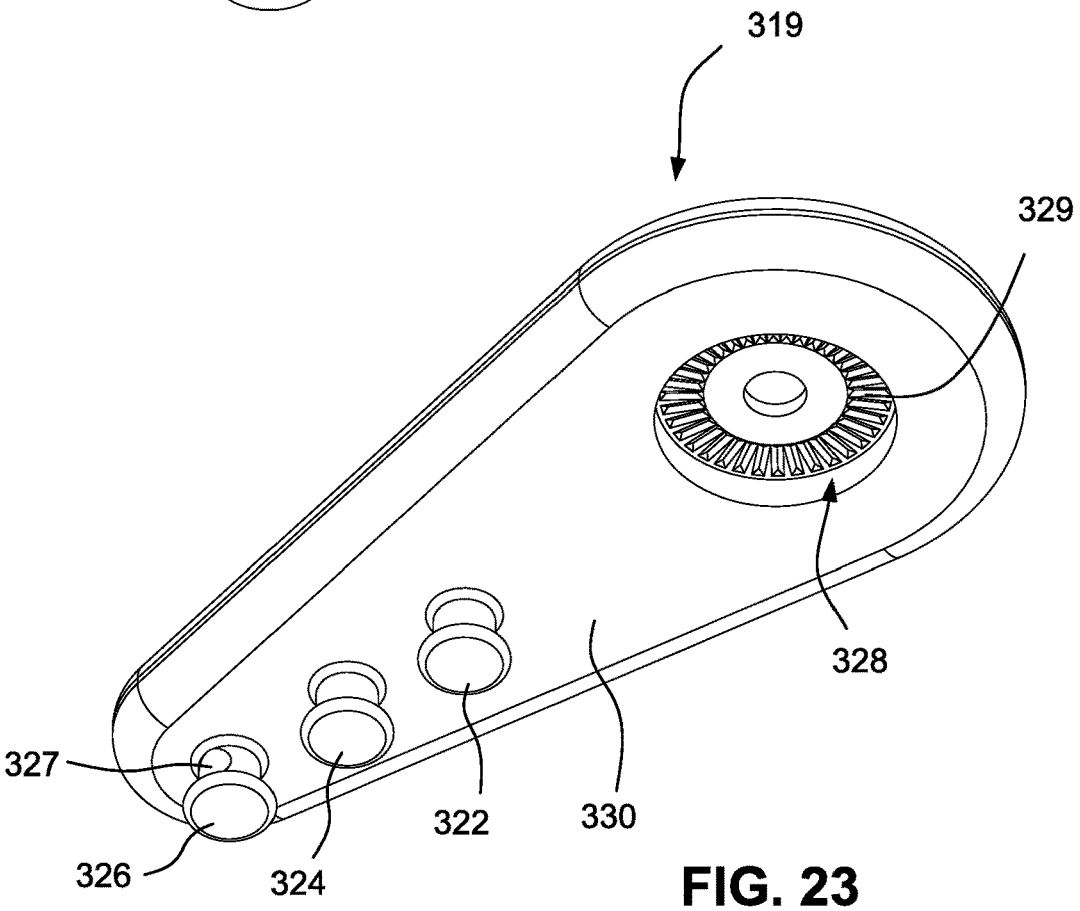
FIG. 23 is a bottom perspective view of the shelf of FIG. 22.

A bottom surface of receiving space 328 has a plurality of protrusions (e.g., wedge-shaped 329). Protrusions 329 may be configured to be received in recesses 317. As shown in FIG. 23, a relatively large number of protrusions 329 are provided such that the protrusions are arranged side-by-side forming a ring shape. Turning to FIG. 20, relatively less recesses 317 are provided. In this manner, leg attachment 319 may be rotated relative to shelf 319 to cause the recesses to slide from receipt of one protrusion to receipt of an adjacent protrusion. This allows adjustment of a rotary position of shelf 319 relative to leg attachment 310 in small increments.

Figure 22:
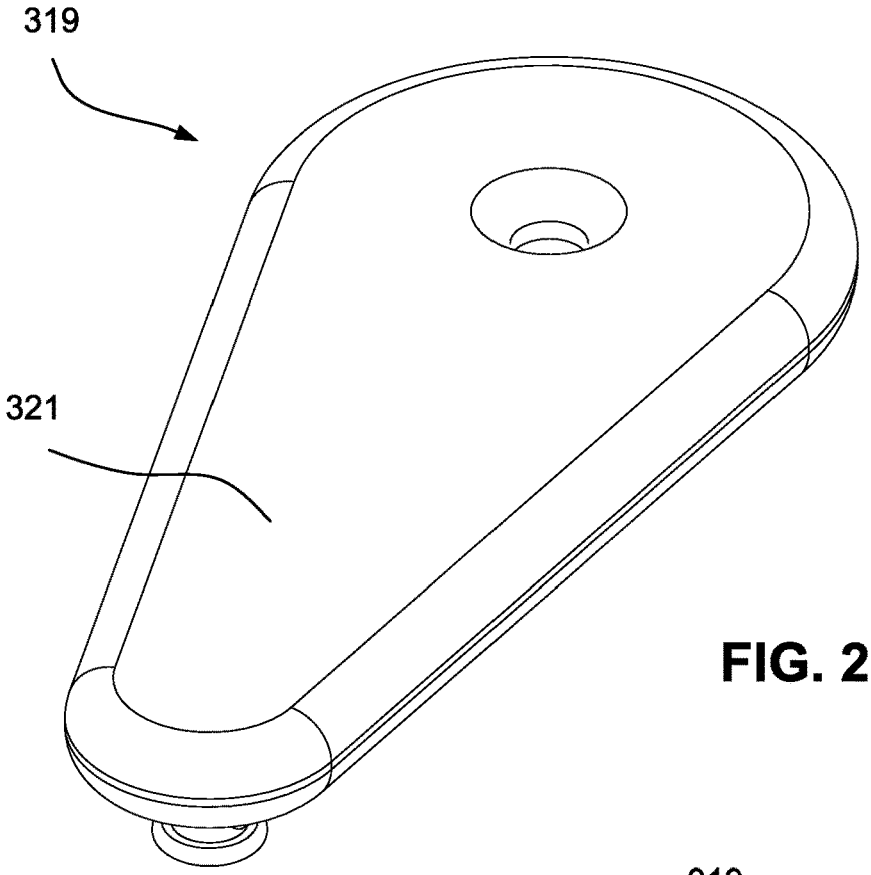
FIG. 22 is a top perspective view of a shelf of the adjustable loom support of FIG. 16.

Referring to FIG. 22, shelf 319 has an upper platform 321 for supporting a variety of different looms. An underside surface 330 of shelf 319 includes receiving space 328 and a plurality of attachment points (e.g., pegs 322, 324, 326), as shown in FIG. 23. Pegs 322, 324, 326 have a narrower neck portion and a wider head portion. Some or all of the pegs, e.g., peg 326 may have a hole formed therein. The pegs are spaced along a length of the shelf to accommodate different size and/or shaped looms (an appropriate peg can be used depending on the size/shape of the loom).

Upper platforms 321 of shelves 319 collectively form a support platform for interchangeably holding a variety of different looms. The shelves are rotatably relative to the leg attachments in order to adjust a size of the support platform. That is, each shelf 319 may be adjusted in order to affect an overall size of the support platform so as to accommodate a wide range of loom sizes and/or shapes.

Those skilled in the art will recognize that other loom supports may be used. For example, arms that grab edges of a loom may be used. Additionally, loom supports may be used with a base that does not rotate.

Figure 24:
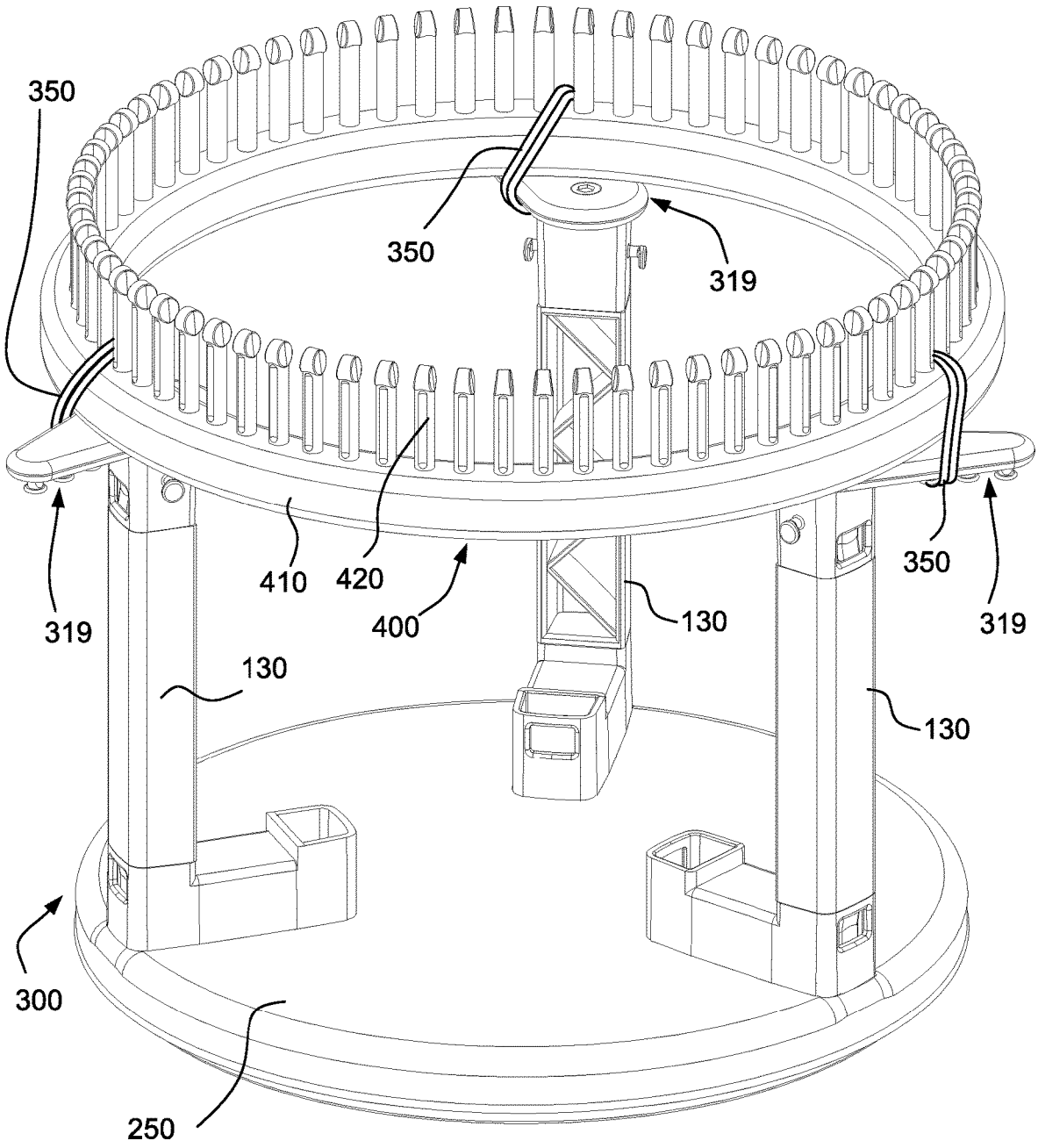
FIG. 24 is a perspective view of the rotating loom holder of FIG. 14 with a circular loom positioned thereon.

Turning to FIG. 24, swiveling loom holder 300 is shown supporting a round loom 400 thereon. Round loom 400 includes a base 410 and a plurality of pegs 420 disposed on the base, as those skilled in the art will understand. It may be noticed that the shelves 319 are connected to the outer support legs 130 (depending on the size of the loom to be held, the inner support legs 140 could be used).

Since loom 400 is now supported on base 150, the knitter may swivel the loom so that the knitting can be worked on one location.

Flexible connector (e.g., elastic band 350) is used to secure loom 400 to each shelf 319, as will be described in detail later.

Figure 25:
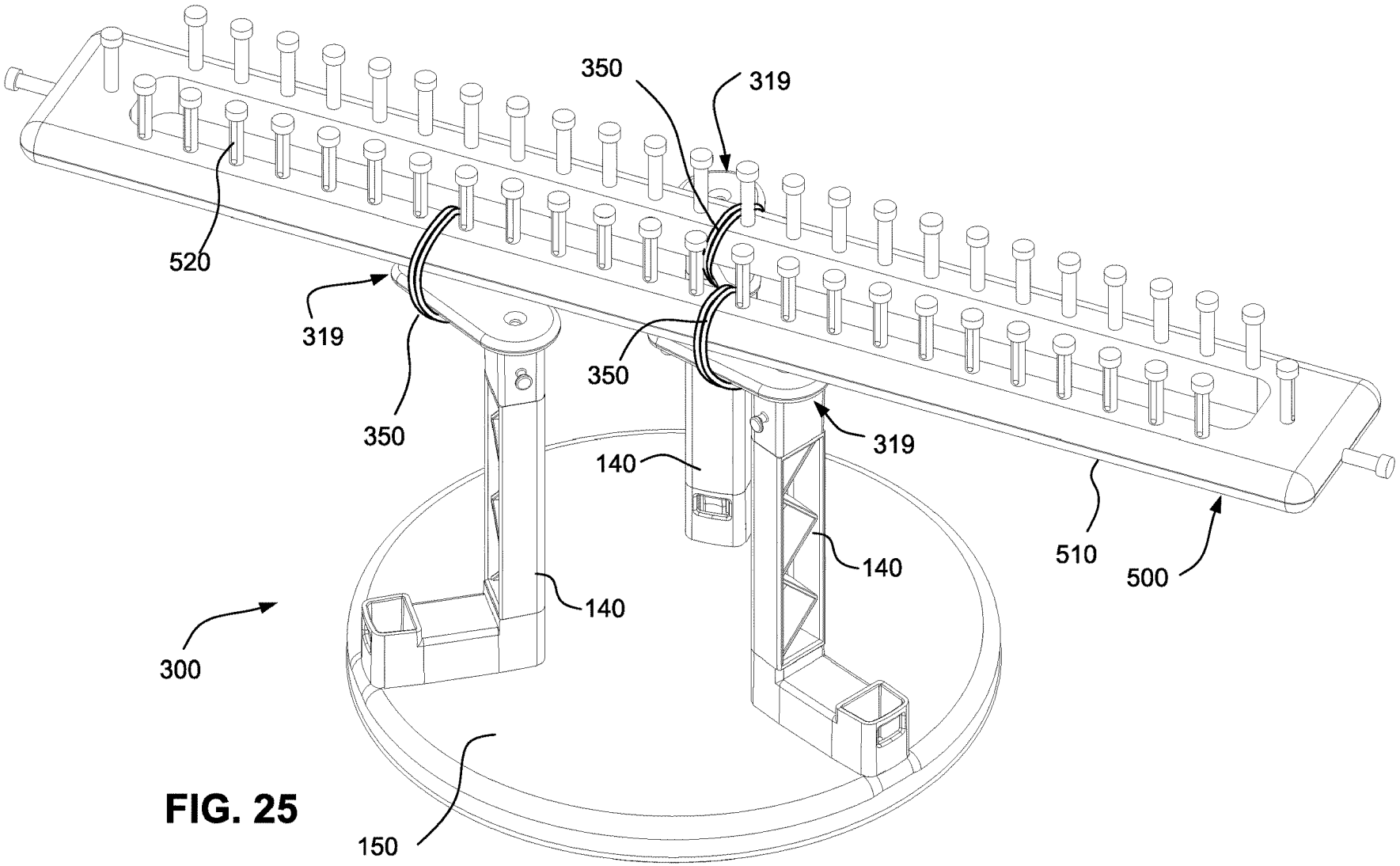
FIG. 25 is a perspective view of the rotating loom holder of FIG. 14 with a rectangular loom positioned thereon.

Turning to FIG. 25, swiveling loom holder 300 is shown supporting a rectangular loom 500 thereon. Rectangular loom 500 includes a base 510 and a plurality of pegs 520 disposed on the base, as those skilled in the art will understand. It may be noticed that the shelves 319 are connected to the inner support legs 140. Those skilled in the art will recognize that some shelves may be connected to the inner support legs whereas other shelves may be connected to the outer support legs.

Figure 26:
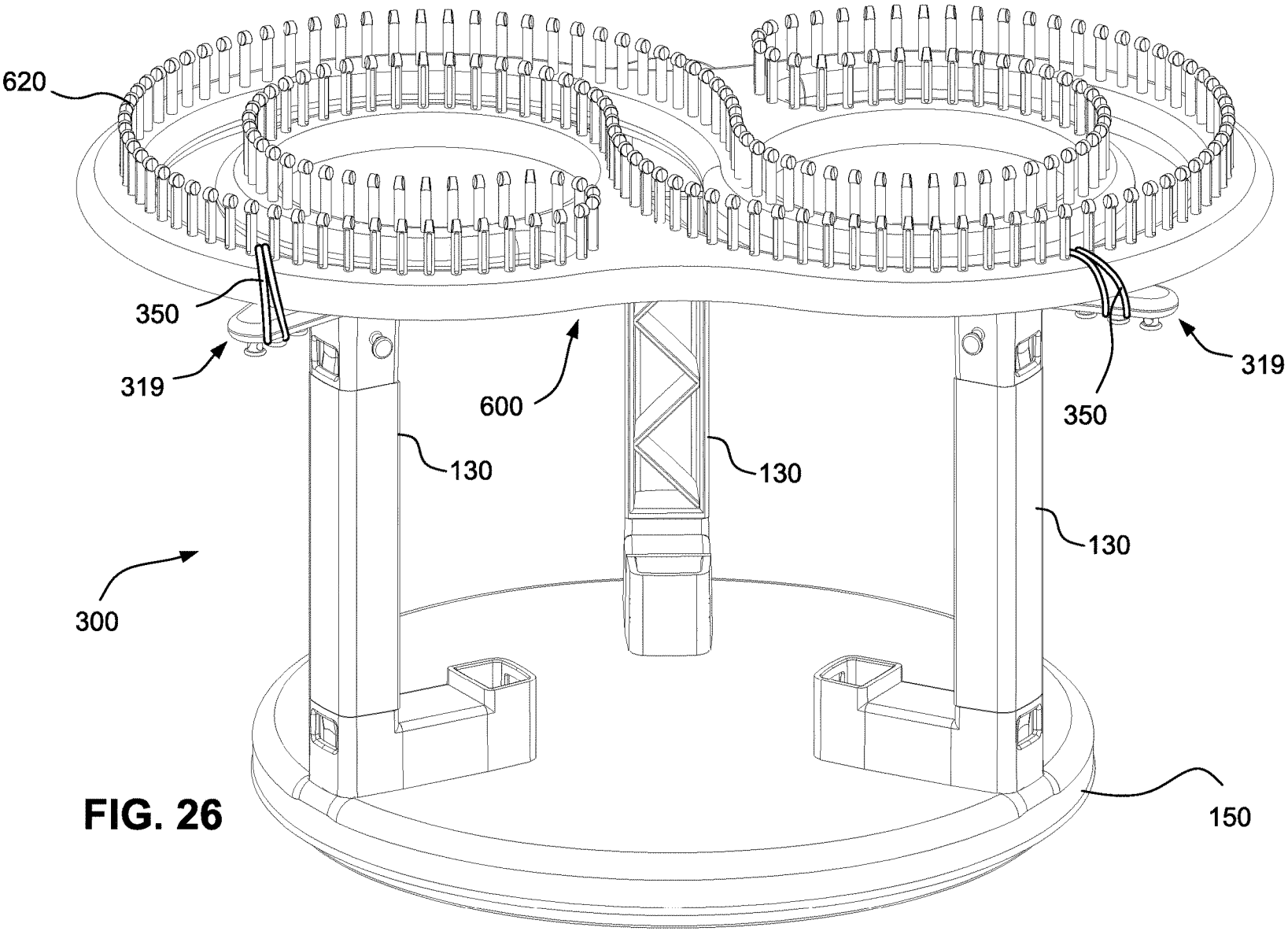
FIG. 26 is a perspective view of the rotating loom holder of FIG. 14 with an S-shaped loom position thereon.

Turning to FIG. 26, swiveling loom holder 300 is shown supporting an S-shaped loom 600 thereon. S-shaped loom 600 includes a base 610 and a plurality of pegs 620 disposed on the base, as those skilled in the art will understand.

Those skilled in the art will recognize that other shaped and sized looms can be supported on the swiveling loom holder.

Figure 27A:
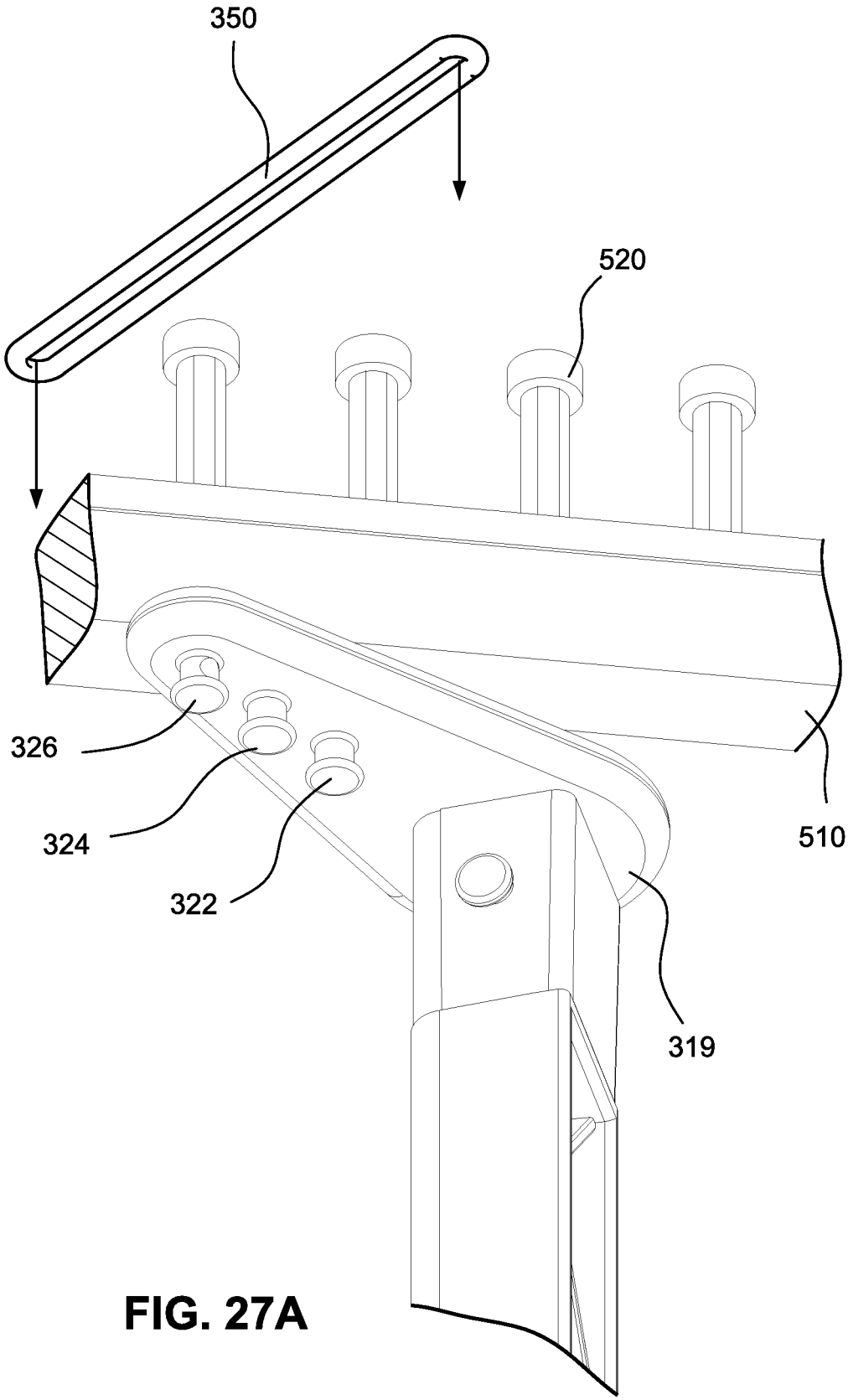
FIGS. 27A to 27C are partial perspective views showing installation of a rectangular loom on the rotating loom holder of FIG. 14.
Figure 27B:
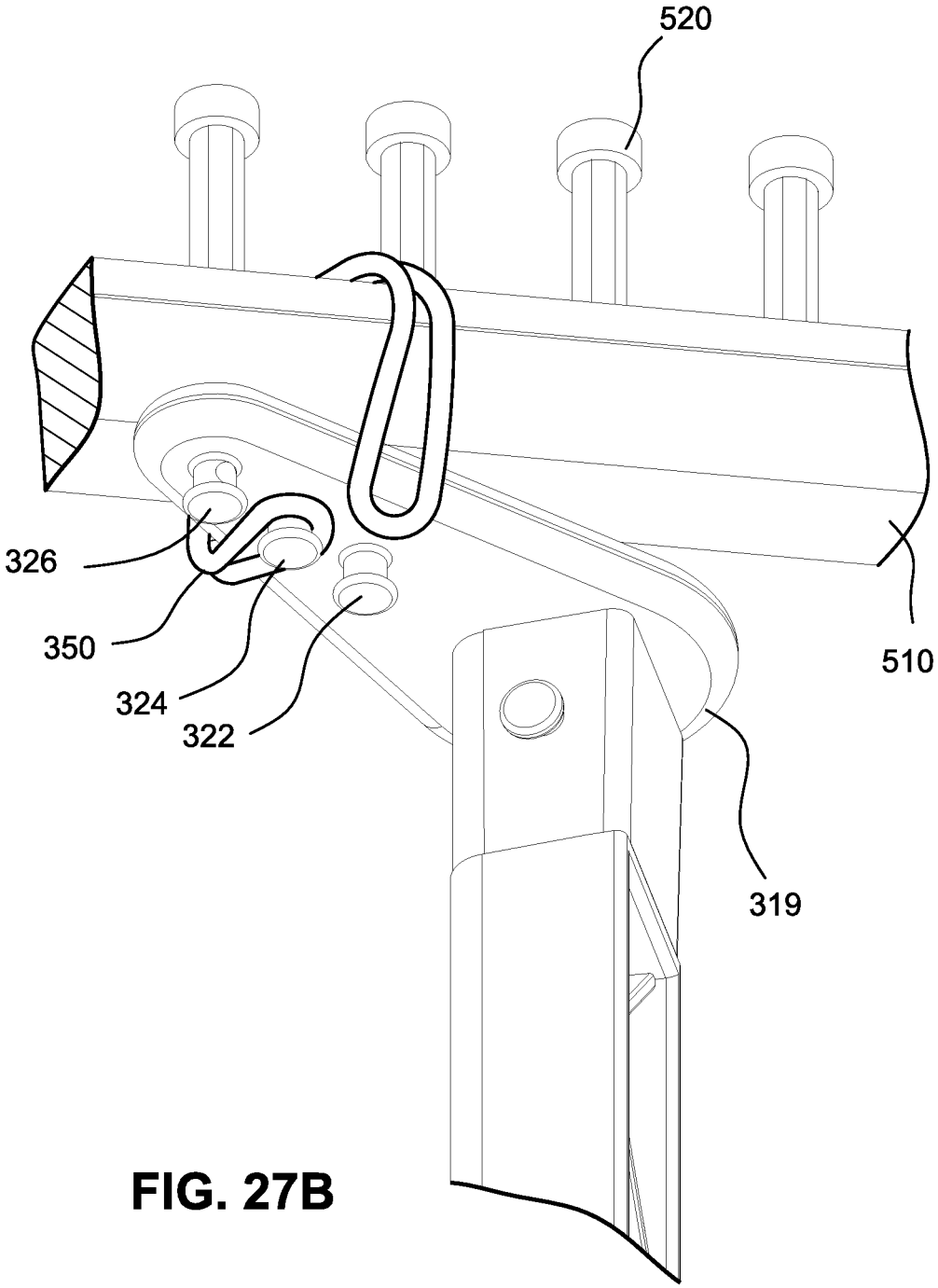
Figure 27C:
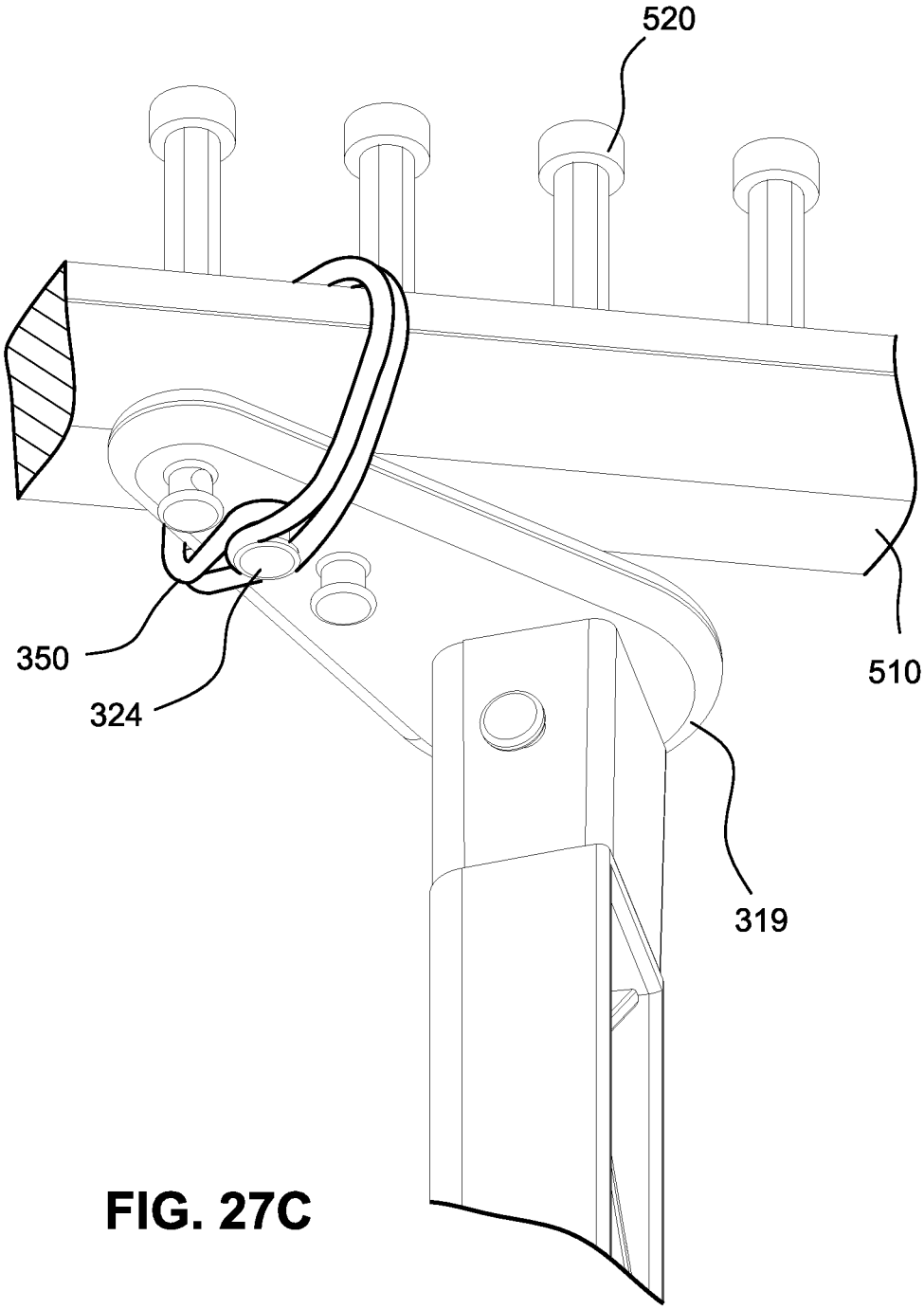

Referring to FIGS. 27A to 27C, a process of using the elastic band 350 to secure rectangular loom 500 is illustrated. FIG. 27A shows the elastic band being positioned between the pegs 520 of the loom. In FIG. 27B, one end of band 350 is hooked on an appropriate peg, and then, as shown in FIG. 27C, the other end of band 350 is hooked on the peg (the ends of the band could be hooked on different pegs). In another example, the looms may be held to the platforms, e.g., with a plastic band or rubber band that fits into small holes in the platform and secured around the loom base. A series of small holes could be formed in the platform extending from the outer perimeter to the inner perimeter to accommodate different size looms. The holes could also extend in another direction. The band could loop over the loom and be secured in a corresponding hole on the platform. For example, one end of the band could be fixed to the platform or have a knob preventing it from pulling through one hole. The other end of the band could have a hook to latch onto another hole or corresponding feature. In another example, the ends of the band could have necklace clasp type connectors (or any other suitable connector). Also, the band could have loops formed at its ends to engage hooks formed on the platform.

While the examples discussed above have been described in connection with what are presently considered to be practical and preferred features, it is to be understood that appended claims are intended to cover modifications and equivalent arrangements included within the spirit and scope of these examples.

What is claimed is:

1. A swiveling hand loom, comprising:

a support base;

a first inner loom forming a closed circle and having a plurality of pegs thereon;

a second outer loom forming a closed circle and having a plurality of pegs thereon;

a plurality of support structures disposed between the support base and the first inner loom and the second outer loom to support the first inner loom and the second outer loom; and a swiveling mechanism permitting the first inner loom and the second outer loom to swivel relative to the support base, wherein the second outer loom is concentrically disposed relative to the first inner loom for double knitting, and wherein the first inner loom and the second outer loom are arranged such that a continuous gap is disposed between the first inner loom and the second outer loom to accommodate a knitted material as it is removed from the pegs.

2. The swiveling loom of claim 1, wherein the plurality of support structures are configured to swivel relative to the support base.

3. The swiveling loom of claim 1, wherein the support base includes the swiveling mechanism.

4. The swiveling loom of claim 3, wherein the swiveling mechanism includes a plurality of bearings.

5. The swiveling loom of claim 4, further comprising a bearing plate, the plurality of bearings being disposed in the bearing plate.

6. The swiveling loom of claim 1, wherein the plurality of support structures comprises a plurality of support legs configured to support the first inner loom and the second outer loom at a vertically-spaced distance from the support base.

7. The swiveling loom of claim 6, wherein the plurality of support legs are detachably connectable to the first inner loom and the second outer loom with a snap fit.

8. The swiveling loom of claim 6, wherein each support leg comprises a lower connector at a lower end portion thereof configured to detachably connect to the support base, and each support leg comprises an upper connector at an upper end portion thereof configured to detachably connect to the first inner loom or the second outer loom.

9. A double-knit hand loom, comprising:

a first inner loom forming a closed circle and having a plurality of pegs thereon; and a second outer loom forming a closed circle and having a plurality of pegs thereon;

a plurality of support structures configured to support the first inner loom and the second outer loom from below, wherein the second outer loom is concentrically disposed relative to the first inner loom for double-knitting by hand, wherein the first inner loom and the second outer loom are arranged with respect to one another such that a continuous gap is disposed between the first inner loom and the second outer loom to accommodate a knitted material as it is removed from the pegs of the first inner loom and the second outer loom, wherein the plurality of support structures comprises a plurality of support legs adapted to support the first inner loom and the second outer loom at a vertically-spaced distance from a support base, and wherein the plurality of support legs comprises a first support leg having an upper portion connected to the first inner loom and a second support leg having an upper portion connected to the second outer loom, wherein a lower portion of the first support leg is coupled to a lower portion of the second support leg such that the first support leg and the second support leg form a U-shape thereby forming the continuous gap between the first inner loom and the second outer loom to accommodate the knitted material as it is removed from the pegs of the first inner loom and the second outer loom.

10. The double-knit hand loom of claim 9, wherein the upper portion of the first support leg is removably connected to the first inner loom with a snap fit.

11. The double-knit hand loom of claim 10, wherein the upper portion of the second support leg is removably connected to the second outer loom with a snap fit.

12. The double-knit hand loom of claim 9, further comprising a support base, wherein each support leg comprises a lower connector at a lower end portion thereof configured to detachably connect to the support base, and each support leg comprises an upper connector at an upper end portion thereof configured to detachably connect to the first inner loom or the second outer loom.

* * * * *